US010511131B2

(12) United States Patent
Anma et al.

(10) Patent No.: US 10,511,131 B2
(45) Date of Patent: Dec. 17, 2019

(54) TERMINAL CRIMPING DEVICE

(71) Applicant: Yazaki Corporation, Tokyo (JP)

(72) Inventors: Hikaru Anma, Shizuoka (JP); Masashi Iwata, Shizuoka (JP); Hideki Saito, Shizuoka (JP); Naoki Ito, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 268 days.

(21) Appl. No.: 15/377,194

(22) Filed: Dec. 13, 2016

(65) Prior Publication Data

US 2017/0179616 A1 Jun. 22, 2017

(30) Foreign Application Priority Data

Dec. 16, 2015 (JP) ..... 2015-244884
Sep. 15, 2016 (JP) ..... 2016-180428

(51) Int. Cl.
*H01R 43/052* (2006.01)
*H01R 43/048* (2006.01)
(Continued)

(52) U.S. Cl.
CPC ..... *H01R 43/052* (2013.01); *H01R 4/185* (2013.01); *H01R 43/048* (2013.01);
(Continued)

(58) Field of Classification Search
CPC ..... H01R 43/048; H01R 43/0482; H01R 43/052; H01R 43/055; H01R 43/058; H01R 4/185; Y10T 29/53235
See application file for complete search history.

(56) References Cited

U.S. PATENT DOCUMENTS 4,654,952 A 4/1987 Baldyga
5,357,669 A * 10/1994 Orphanos ..... H01R 43/055 29/566.3
(Continued)

FOREIGN PATENT DOCUMENTS

CN 1172357 A 2/1998
CN 101548443 A 9/2009
(Continued)

OTHER PUBLICATIONS

Chinese Office Action for the related Chinese Patent Application No. 201611157999.6 dated Sep. 19, 2018.

*Primary Examiner* — A. Dexter Tugbang
(74) *Attorney, Agent, or Firm* — Kenealy Vaidya LLP

(57) ABSTRACT

A terminal crimping device includes a terminal feeding device, a crimping device and an electric-wire holding mechanism that holds an electric wire with an end portion of the electric wire placed above an electric-wire connecting portion of a crimp terminal. The electric-wire holding mechanism includes an upper surface of a terminal cutting body, on which the electric wire is placed, and an electric-wire presser that is moved downward toward the upper surface and presses and thereby holds the electric wire placed on the upper surface. Between the electric-wire placing portion and a lower surface of the electric-wire presser, an electric-wire holding space is formed that inclines in the same direction to a declining direction in which the end portion of the electric wire is declined in association with downward move of the second die toward the first die, and that holds the electric wire in a thus inclined state.

20 Claims, 18 Drawing Sheets

(51) Int. Cl.
*H01R 4/18* (2006.01)
*H01R 43/055* (2006.01)
*H01R 43/058* (2006.01)

(52) U.S. Cl.
CPC ..... *H01R 43/0482* (2013.01); *H01R 43/055* (2013.01); *H01R 43/058* (2013.01); *Y10T 29/53235* (2015.01)

(56) References Cited

U.S. PATENT DOCUMENTS

| | | | | |
|---|---|---|---|---|
| 2001/0015366 | A1 | 8/2001 | Yamakawa | |
| 2002/0184753 | A1* | 12/2002 | Wilson ..... | H01R 43/048 29/751 |
| 2011/0136397 | A1 | 6/2011 | Koga et al. | |
| 2016/0006164 | A1 | 1/2016 | Sato | |

FOREIGN PATENT DOCUMENTS

| | | | | |
|---|---|---|---|---|
| GB | 2 275 430 | A | | 8/1994 |
| JP | 6-236792 | A | | 8/1994 |
| JP | 8-111275 | A | | 4/1996 |
| JP | 10-223347 | A | | 8/1998 |
| JP | 2000-252035 | A | | 9/2000 |
| JP | 2001-230043 | A | | 8/2001 |
| JP | 2008-177030 | A | | 7/2008 |
| JP | 2008-181813 | A | | 8/2008 |
| JP | 2009146840 | A | * | 7/2009 |
| JP | 4833246 | B2 | | 12/2011 |
| JP | 2014-182953 | A | | 9/2014 |
| JP | 2014-182957 | A | | 9/2014 |
| JP | 2014-203735 | A | | 10/2014 |
| WO | 2014/148481 | A1 | | 9/2014 |

* cited by examiner

TERMINAL CRIMPING DEVICE

CROSS-REFERENCE TO RELATED APPLICATION(S)

The present application claims priority to and incorporates by reference the entire contents of Japanese Patent Application No. 2015-244884 filed in Japan on Dec. 16, 2015 and Japanese Patent Application No. 2016-180428 filed in Japan on Sep. 15, 2016.

BACKGROUND OF THE INVENTION

1. Field of the Invention

The present invention relates to a terminal crimping device.

2. Description of the Related Art

Crimp terminals, which are electrically connected to electric wires by being crimped onto end portions of these electric wires, have been conventionally known (Japanese Patent Application Laid-open No. 2014-182957, Japanese Patent Application Laid-open No. 2014-182953, Japanese Patent Application Laid-open No. 2000-252035, Japanese Patent Application Laid-open No. 2001-230043, Japanese Patent Application Laid-open No. H8-111275, and Japanese Patent Application Laid-open No. 2014-203735). Crimping processes applied to those crimp terminals and the end portions of the electric wires are performed by use of terminal crimping devices disclosed in, for example, Japanese Patent Application Laid-open No. 2014-182953, Japanese Patent Application Laid-open No. 2000-252035, Japanese Patent Application Laid-open No. 2001-230043, Japanese Patent Application Laid-open No. H8-111275, and Japanese Patent Application Laid-open No. 2014-203735. Each of the terminal crimping devices feeds the first crimp terminal among crimp terminals chained to one another (a terminal chain body) until it reaches a certain position, and then causes a terminal cutting machine to cut off this crimp terminal from the terminal chain body while causing a first die and a second die to pinch this crimp terminal and an electric wire therebetween to crimp the crimp terminal onto the electric wire.

In such a case, the terminal cutting machine includes a terminal cutting body that has a slit into which a connecting piece of the terminal chain body is inserted. The terminal cutting body utilizes an opening edge at the upper end of the slit as a cutting blade of a crimp terminal. As the crimping process progresses, this terminal cutting body moves downward along the first die and cuts off the crimp terminal from the terminal chain body. Here, before the crimping process is performed, the electric wire is placed on the upper surface of the terminal cutting body, and the electric wire is pressed by an electric wire presser so as to prevent the uplift of the electric wire from this upper surface.

The electric wire in this state is held between the terminal cutting body and the electric-wire presser with the end portion thereof lifted up from an electric-wire connecting portion. In line with the progress of the crimping process (the downward move of the second die toward the first die), the end portion of the electric wire is pressed down toward the electric-wire connecting portion. Consequently, the electric wire is bent between a part thereof held by the terminal cutting body and the electric-wire presser and a part thereof pressed down by the second die, and the thus bent part thereof comes under load. It is then likely that the position of an end portion of the electric wire is displaced relative to the electric-wire connecting portion because of the load acting on the electric wire.

SUMMARY OF THE INVENTION

It is an object of the present invention to provide a terminal crimping device that can improve crimping process accuracy of a crimp terminal and an electric wire.

In order to achieve the above mentioned object, a terminal crimping device includes a terminal feeding device that feeds, to a crimping position at which a crimp terminal is crimped to an electric wire, the crimp terminal on which a crimping process has not yet been performed; a crimping device that crimps the crimp terminal having been fed to the crimping position to an end portion of the electric wire by using a first die and a second die; and an electric-wire holding mechanism that holds the electric wire with the end portion of the electric wire is placed above an electric-wire connecting portion of the crimp terminal, wherein the electric-wire holding mechanism includes an electric-wire placing portion on which the electric wire is placed with the end portion of the electric wire is placed above the electric-wire connecting portion of the crimp terminal, and an electric-wire presser that is moved downward toward the electric-wire placing portion and presses and thereby holds the electric wire placed on the electric-wire placing portion, and between the electric-wire placing portion and a lower surface of the electric-wire presser, an electric-wire holding space is formed that inclines in the same direction to a declining direction in which the end portion of the electric wire is declined in association with downward move of the second die toward the first die, and that holds the electric wire in a thus inclined state.

According to another aspect of the present invention, in the terminal crimping device, it is preferable that the electric-wire holding space is formed by a recessed portion formed in the electric-wire placing portion and a recessed portion formed in the lower surface of the electric-wire presser.

According to still another aspect of the present invention, in the terminal crimping device, it is preferable that the recessed portion in the electric-wire placing portion is a V-shaped groove having side walls the distance between which increases while approaching the lower surface of the electric-wire presser and having a groove bottom inclined so as to be more distant from the lower surface of the electric-wire presser while approaching the end portion of the electric wire, and the recessed portion in the electric-wire presser is a V-shaped groove having side walls the distance between which increases while approaching the electric-wire placing portion and having a groove bottom inclined so as to be nearer to the electric-wire placing portion while approaching the end portion of the electric wire.

According to still another aspect of the present invention, in the terminal crimping device, it is preferable that a length of a portion of the electric wire that is held by the electric-wire holding space in the recessed portion in the electric-wire presser, along an axial line thereof, is set to a length that causes the electric wire to be held in the inclined state by the electric-wire holding space when the electric wire is pressed down, sequentially from one side thereof having a core wire exposed at a tip, toward a bottom portion of the electric-wire connecting portion by the second die.

According to still another aspect of the present invention, it is preferable that the terminal crimping device further includes a locking portion that locks the electric-wire presser that is moving downward, and that makes a minimum vertical distance to the recessed portion in the electric-wire presser at the completion of the crimping process larger than a diameter of the electric wire.

According to still another aspect of the present invention, in the terminal crimping device, it is preferable that an inclination angle of the electric-wire holding space is set equal to an inclination angle of the end portion of the electrical wire with respect to the electric-wire connecting portion during the crimping process is performed.

According to still another aspect of the present invention, in the terminal crimping device, it is preferable that before the crimping process is actually started or at the same time as the crimping process is actually started, the electric-wire presser is moved downward in a manner that causes the electric wire to be held by the electric-wire holding space.

According to still another aspect of the present invention, in the terminal crimping device, it is preferable that, in a case where, while a plurality of crimp terminals are coupled with a connecting piece with a bridging part bridging each of the crimp terminals and the connecting piece, the electric-wire placing portion is provided in a terminal cutting machine that cuts the bridging part of one of the crimp terminals by inserting and pinching the bridging part between two terminal cutting parts, the one of the crimp terminals having been fed to the crimping position, the terminal cutting machine includes a terminal cutting body that has one of the terminal cutting parts and moves down in order to move the one of the terminal cutting parts toward the other one of the terminal cutting parts, the terminal cutting body including a slit into which the connecting piece is inserted with a part of the bridging part coupled with one of the crimp terminals being projected, the one of the crimp terminals having been fed to the crimping position, and an upper edge portion as the one of the terminal cutting parts that is located at an opening of the slit that faces the crimp terminal, and the terminal cutting machine utilizes an upper surface of the terminal cutting body as the electric-wire placing portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
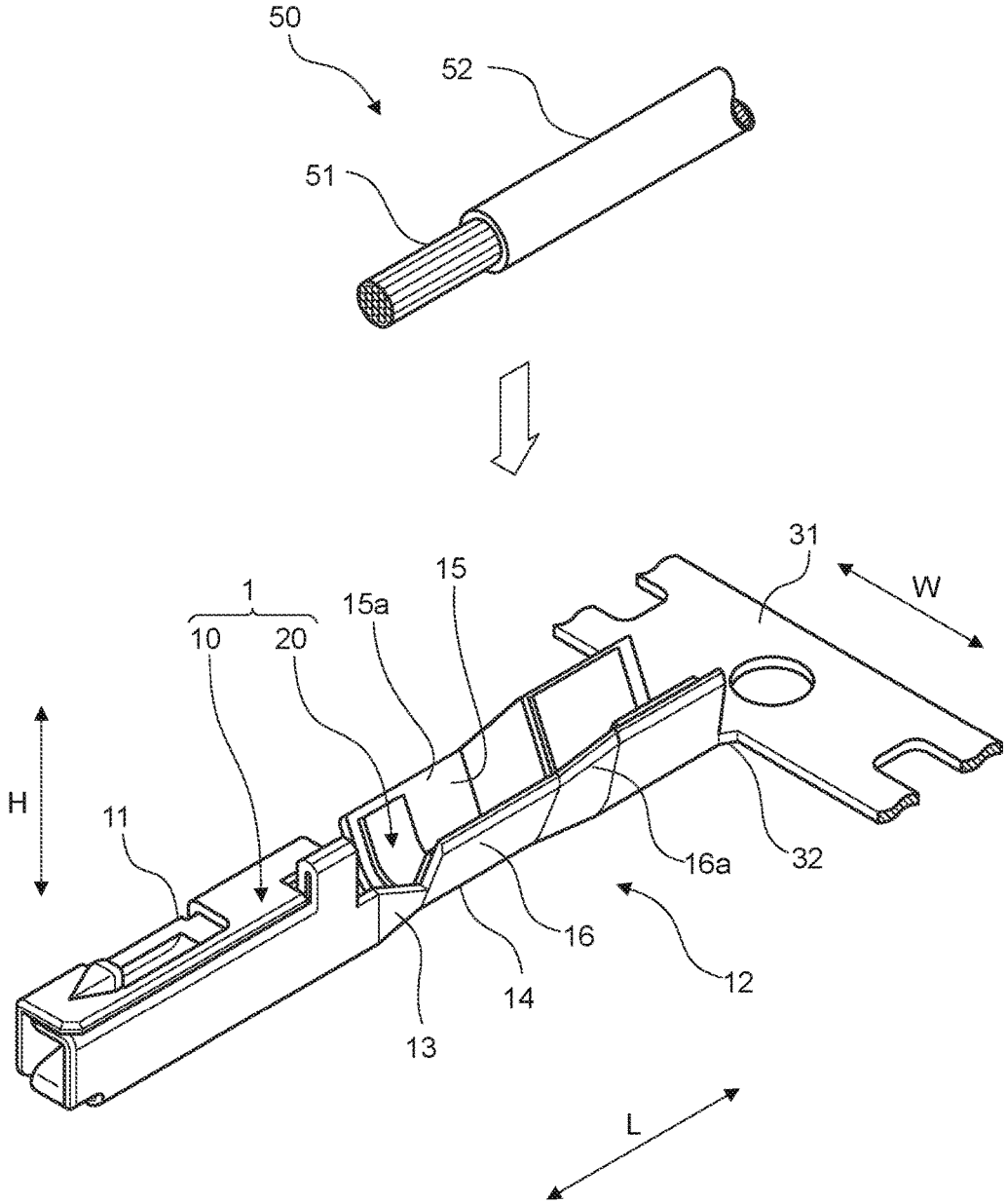
FIG. 1 is a perspective view illustrating a crimp terminal according to an embodiment, depicting a state thereof before the crimp terminal is connected to an electric wire.
Figure 2:
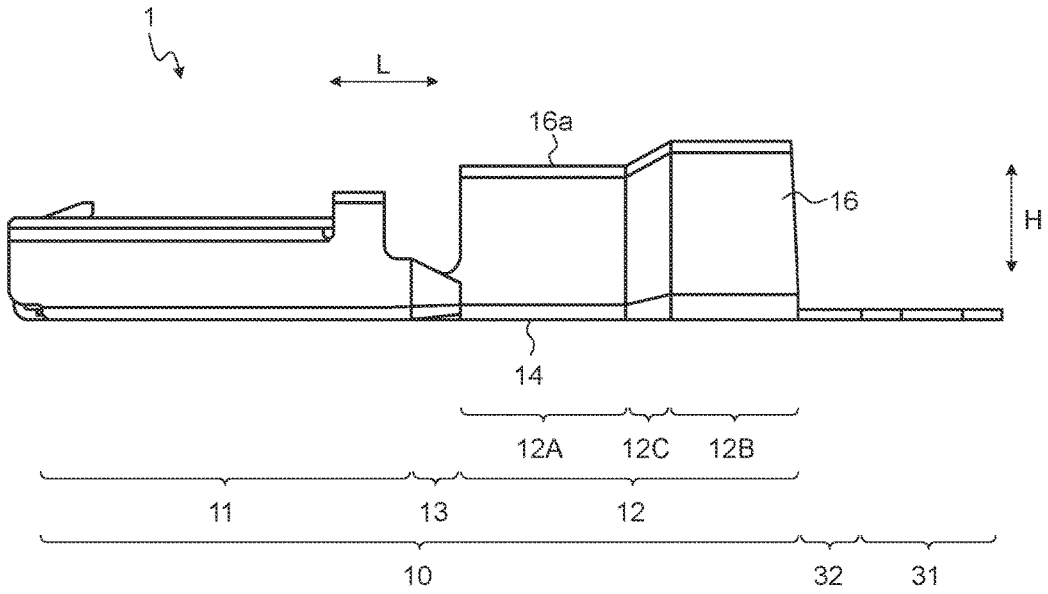
FIG. 2 is a side view illustrating the crimp terminal according to the embodiment, depicting a state thereof when an electric-wire connecting portion has been formed into a U shape.
Figure 3:
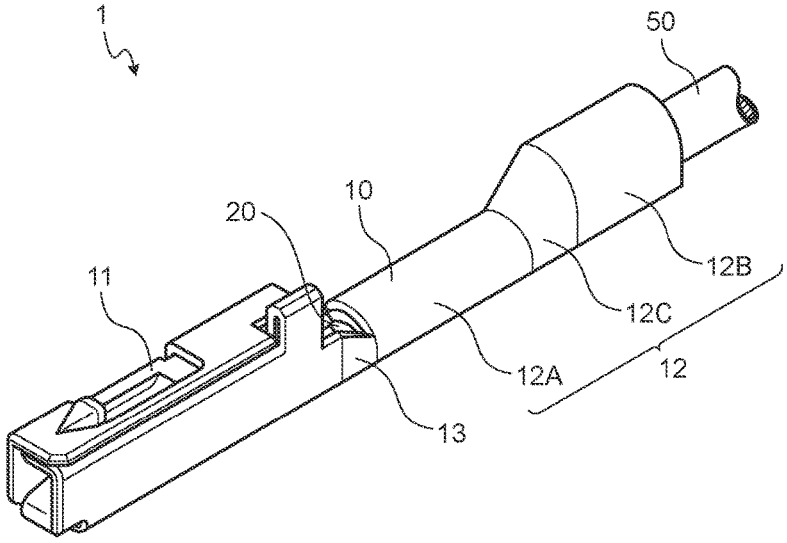
FIG. 3 is a perspective view illustrating the crimp terminal after the completion of crimping in the embodiment.
Figure 4:
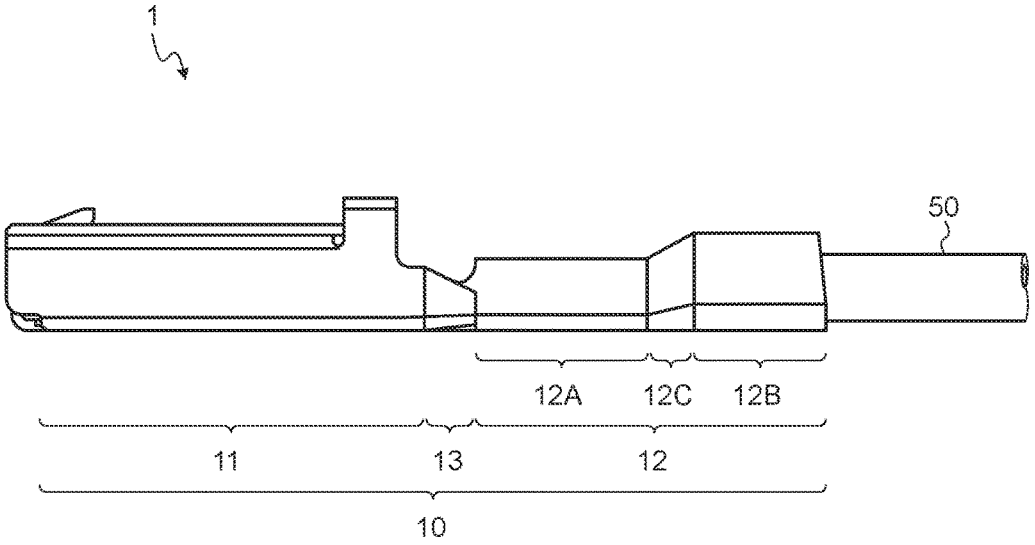
FIG. 4 is a side view illustrating the crimp terminal after the completion of crimping in the embodiment.

The following describes an embodiment of a terminal crimping device according to the present invention in detail with reference to the drawings. This embodiment is not intended to limit this invention.

EMBODIMENT

One embodiment of a terminal crimping device according to the present invention is described with reference to FIG. 1 to FIG. 17.

First, a crimp terminal to be crimped to an electric wire is described. Reference sign 1 in FIG. 1 to FIG. 4 indicates a crimp terminal according to this embodiment. This crimp terminal 1 is electrically connected to an electric wire 50, and then, while being integral with this electric wire 50, is electrically connected to a counterpart terminal (not illustrated). Here, in an end portion of the electric wire 50, a portion corresponding to a certain length of a cover 52 is stripped and removed so that a portion corresponding to the certain length of a core wire 51 can be exposed. The core wire 51 may be an aggregate of a plurality of strands, or may be a single strand such as a coaxial cable. In order to be electrically connected to this electric wire 50, the crimp terminal 1 is crimped to the end portion of the electric wire 50, thereby being electrically connected to an exposed portion of the core wire 51 at the tip (hereinafter referred to simply as "the core wire 51 at the tip").

Specifically, the crimp terminal 1 includes a terminal fitting 10 and a water stop member 20.

Figure 5:
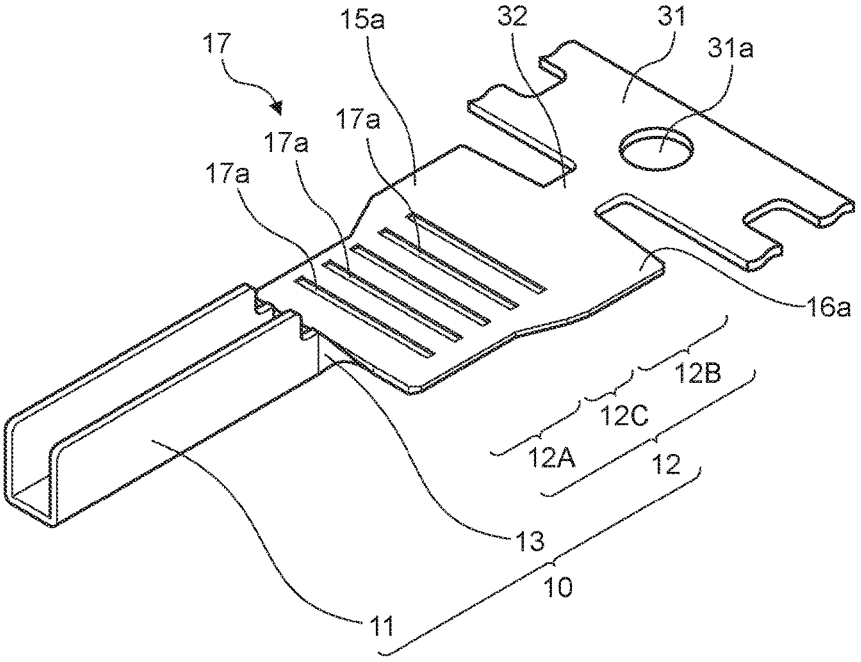
FIG. 5 is a perspective view illustrating a terminal fitting of the crimp terminal according to the embodiment, depicting a state thereof before a water stop member is affixed onto the electric wire.

The terminal fitting 10 is a main body part of this crimp terminal 1 in this example. This terminal fitting 10 is obtained by using an electroconductive metal plate (for example, a copper plate) as a base material and performing thereon a punching process or a bending process to form it into a certain shape that enables attachment of the terminal fitting 10 to the counterpart terminal and the electric wire 50. This terminal fitting 10 includes, as illustrated in FIG. 5, a terminal connecting portion 11 that is electrically connected to the counterpart terminal, and an electric-wire connecting portion 12 that is electrically connected to the electric wire 50. The terminal connecting portion 11 and the electric-wire connecting portion 12 are joined together by a coupling portion 13 interposed therebetween.

The terminal fitting 10 may be a male terminal or may be a female terminal. The terminal connecting portion 11 is formed into a male type when the terminal fitting 10 is a male terminal, or formed into a female type when the terminal fitting 10 is a female terminal. The example given in this embodiment is a female terminal.

Here, in this crimp terminal 1, a direction of connection thereof to (insertion thereof into) the counterpart terminal is defined as a first direction L, which indicates the longitudinal direction thereof. A direction to be described later in which the crimp terminals 1 are arrayed alongside one another is defined as a second direction W, which indicates the width direction of the crimp terminal 1. In addition, in this crimp terminal 1, a direction perpendicular to both of the first direction L and the second direction W is defined as a third direction H, which indicates the height direction thereof.

The electric-wire connecting portion 12 is originally formed as a single plate-shaped piece (FIG. 5), and is then formed into a U shape, which is a state immediately preceding connection thereof to the electric wire 50 (FIG. 1). This electric-wire connecting portion 12 is then wrapped around the electric wire 50 with the end portion of the electric wire 50 placed thereon, thereby being crimped to the end portion of the electric wire 50 and making contact with the core wire 51 at the tip.

Figure 6:
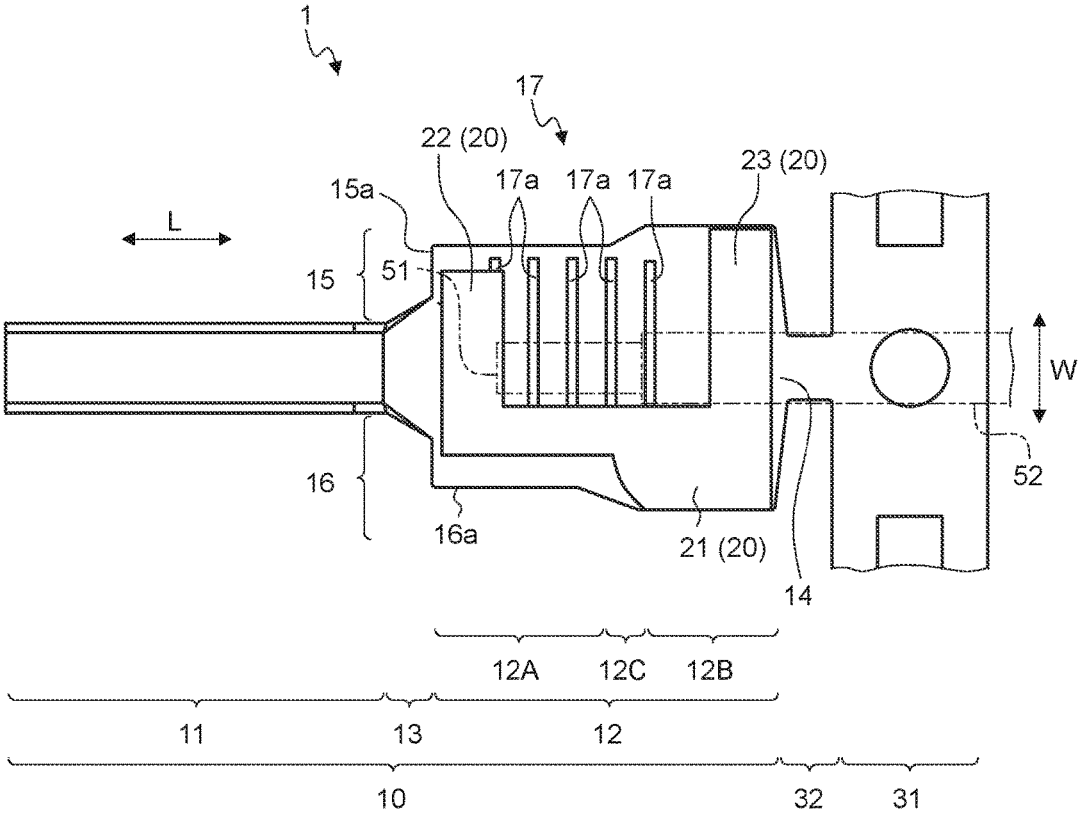
FIG. 6 is a top view illustrating the terminal fitting of the crimp terminal according to the embodiment, depicting a state thereof after a water stop member is affixed onto the electric wire.

This electric-wire connecting portion 12 can be divided into a region of a bottom portion 14, a region of a first barrel piece 15, and a region of a second barrel piece 16 (FIG. 1 and FIG. 6). The bottom portion 14 is a section that forms a bottom wall of the then U-shaped electric-wire connecting portion 12, and the end portion of the electric wire 50 is placed on this bottom portion 14 when a crimping process is performed. The first and the second barrel pieces 15 and 16 are sections that form side walls of the then U-shaped electric-wire connecting portion 12, and are provided so as to extend from opposite ends of the bottom portion 14 in the second direction W. In the then U-shaped electric-wire connecting portion 12, the first and the second barrel pieces 15 and 16 extend from the opposite ends of the bottom portion 14 in such a manner as to surround the end portion of the electric wire 50.

The first barrel piece 15 and the second barrel piece 16 may be formed so that the distances from the base ends thereof facing the bottom portion 14 to leading ends 15*a* and 16*a* can be of the same length, or may be formed so that one of these distances can be longer than the other. The former case is taken as the example in this embodiment. In addition, the first barrel piece 15 and the second barrel piece 16 may be configured to be wrapped around the end portion of the electric wire 50 and overlap each other at the same time, or may be configured (for example, as what are called B-type crimps) to be folded back toward the bottom portion 14 and have the leading ends 15*a* and 16*a* swaged onto the end portion of the electric wire 50. In this embodiment, the former configuration is employed because the water stop member 20 is included. The first barrel piece 15 and the second barrel piece 16 in this embodiment is formed as a single piece, with each having, as described later, a core-wire crimping portion 12A and a cover crimping portion 12B with a coupling crimping portion 12C interposed therebetween. However, this crimp terminal 1 may be formed with a space between a barrel piece in the core-wire crimping portion 12A and a barrel piece in the cover crimping portion 12B, that is, be formed with the core-wire crimping portion 12A and the cover crimping portion 12B joined only by a coupling portion (not illustrated) provided in the bottom portion 14.

Here, the end portion of the electric wire 50 is inserted into a space inside the U shape through one side thereof having an opening (through an opening formed between the end surfaces of the respective leading ends 15*a* and 16*a*) of the U shape of the electric-wire connecting portion 12. For this reason, in the electric-wire connecting portion 12, the gap between the first barrel piece 15 and the second barrel piece 16 increases as going from the bottom portion 14 to the opening side (the leading ends 15*a* and 16*a*) so that the end portion of the electric wire 50 can be more reliably inserted.

Furthermore, this electric-wire connecting portion 12 can be divided into a region of the core-wire crimping portion 12A, a region of the cover crimping portion 12B, and a region of the coupling crimping portion 12C (FIG. 2 and FIG. 4 to FIG. 6). The core-wire crimping portion 12A is a section to be crimped to the core wire 51 at the tip and continues into the coupling portion 13. The cover crimping portion 12B is a section to be crimped to a portion of the cover 52 that continues into the base of the exposed portion of the core wire 51 at the tip. The coupling crimping portion 12C is a section that joins the core-wire crimping portion 12A and the cover crimping portion 12B together and that is to be crimped to the end portion of the electric wire 50.

In the electric-wire connecting portion 12, a core-wire holding region (hereinafter referred to as "serration region") 17 for holding the crimped core wire 51 at the tip is provided in an inner wall surface (a wall surface on the side thereof that wraps the electric wire 50) (FIG. 5 and FIG. 6). The serration region 17 is arranged at least in a part of the inner wall surface of the electric-wire connecting portion 12, the part being to be wrapped around the core wire 51 at the tip. The serration region 17 in this example is formed so as to entirely cover the core wire 51 at the tip. Specifically, the serration region 17 according to this embodiment is obtained by arranging a plurality of recessed portions, a plurality of salient portions, or a combination of a plurality of salient portions and a plurality of salient portions in a rectangular formation. The serration region 17 is intended to increase the adhesion strength between the electric-wire connecting portion 12 and the core wire 51 at the tip by increase the contact area therebetween with salient portions and/or salient portions. In this example, the rectangular serration region 17 is formed of a plurality of recessed portions 17*a*.

Here, the electric-wire connecting portion 12 and the core wire 51 at the tip need to be kept electrically connected to each other. For that purpose ingress of water therebetween possibly reduces durability and is therefore undesirable. For example, when the electric-wire connecting portion 12 and the core wire 51 are formed of different metal materials (such as copper and aluminum) having different strong and weak ionization tendencies, ingress of water therebetween possibly causes corrosion, particularly of the aluminum side.

For this reason, this crimp terminal 1 includes the water stop member 20 for preventing the ingress of water between the electric-wire connecting portion 12 and the core wire 51 at the tip (FIG. 1 and FIG. 6). The water stop member 20 is formed mainly of an adhesive such as a modified acrylic adhesive, and formed in a sheet-like shape. For example, as the water stop member 20, a member obtained by impregnating sheet-like nonwoven cloth with the adhesive, and has adhesion effect on both sides of the sheet. However, it is not necessary to provide the water stop member 20, for example, when the electric-wire connecting portion 12 and the core wire 51 are formed of the same metal material (such as copper).

The water stop member 20 is formed in a certain shape, and is affixed to the inner wall surface of the then flat plate-shaped electric-wire connecting portion 12 illustrated in FIG. 5. The water stop member 20 in this example includes a first water stop part 21, a second water stop part 22, and a third water stop part 23 (FIG. 6). The first water stop part 21 is a part in which a water stop region is formed in at least a part corresponding to an overlap of the first barrel piece 15 and the second barrel piece 16 (that is, an overlap region) after the completion of crimping. The first water stop part 21 is a region that prevents the ingress of water into an interstice between the electric-wire connecting portion 12 and the core wire 51 at the tip from a space between the first barrel piece 15 and the second barrel piece 16. The second water stop portion 22 is at least a part in which a water stop region is formed in a side closer to the terminal connecting portion 11 than the core wire 51 at the tip in the inner side of electric-wire connecting portion 12 after the completion of crimping. The second water stop part 22 is a region that prevents the ingress of water from the terminal connecting portion 11 side into an interstice between the electric-wire connecting portion 12 and the core wire 51 at the tip. The third water stop part 23 is at least a part in which a water stop region is formed between an inner wall surface of the electric-wire connecting portion 12 (specifically, the cover crimping portion 12B) and the cover 52 after the completion of crimping. The third water stop part 23 is a region that prevents the ingress of water from a space therebetween into an interstice between the electric-wire connecting portion 12 and the core wire 51 at the tip. This water stop member 20 functions to block communication of the end portion of the electric wire 50 with the outside in the electric-wire connecting portion 12, thereby being capable of preventing the ingress of water into an interstice between the electric-wire connecting portion 12 and the core wire 51 at the tip.

The terminal fitting 10 described above is formed in the following manner: a single metal plate used as a base material undergoes a pressing step to be formed into a shape including the electric-wire connecting portion 12 shaped like a flat plate as illustrated in FIG. 5; and then, at a water stop member affixing step, the water stop member 20 is affixed on the electric-wire connecting portion 12 shaped like a flat plate. Thereafter, in this terminal fitting 10, the terminal connecting portion 11 is formed, and the electric-wire connecting portion 12 shaped like a letter U, at a folding step.

Figure 7:
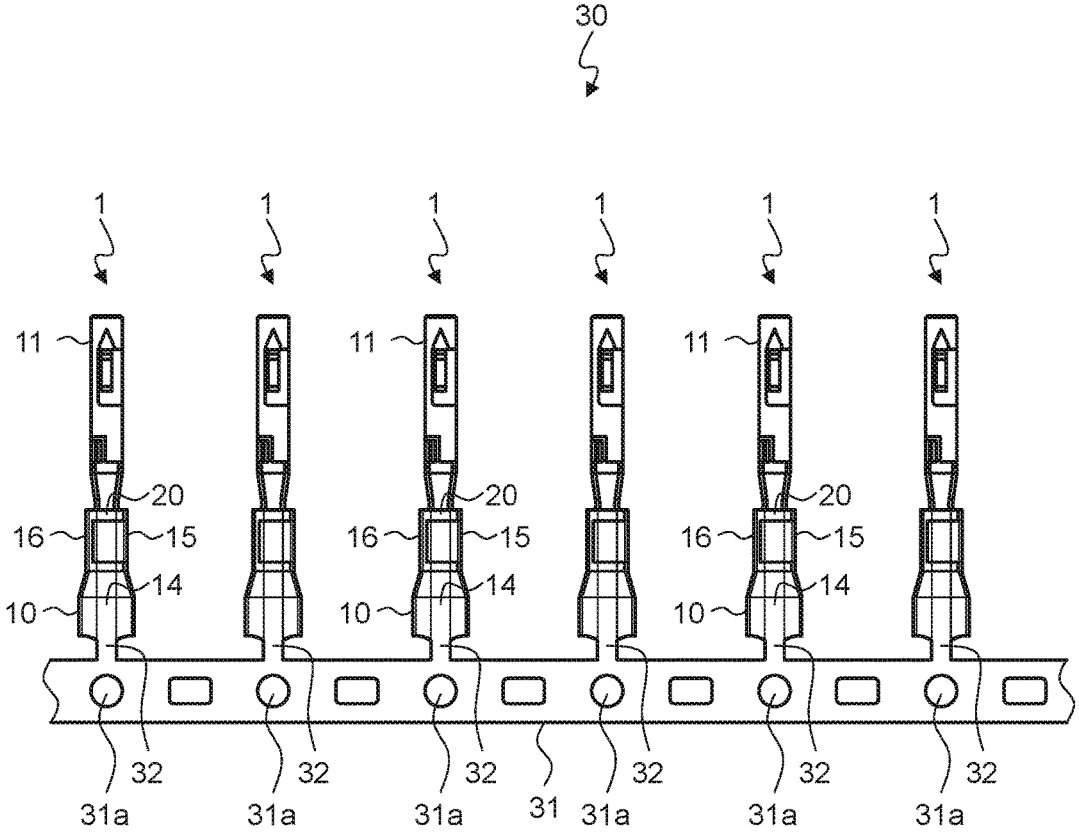
FIG. 7 is a view explaining a terminal chain body.

A plurality of crimp terminals 1 having undergone the above-described steps are arrayed alongside one another to form a terminal chain body (hereinafter referred to as "chain body") 30 (FIG. 7). The terminal chain body 30 means an aggregate of a plurality of crimp terminals 1 that are arranged parallel to each other at uniform intervals and linked to one another in a chain-like fashion with all of the crimp terminals 1 oriented in the same direction. In the terminal chain body 30, end portions of all of the crimp terminals 1 on one side are linked to one another via a connecting piece 31. The connecting piece 31 is formed in, for example, a rectangular plate shape, and is arranged at a certain distance from each of the electric-wire connecting portions 12 of all of the crimp terminals 1. For example, a bridging part 32 shaped like a rectangular plate bridges together the bottom portion 14 of the electric-wire connecting portion 12 and the connecting piece 31 with respect to each of the crimp terminals 1. In the connecting piece 31, through-holes (hereinafter referred to as "terminal feeding holes") 31*a* for feeding the terminal chain body 30 to a crimping position of a terminal crimping device 100 are formed at uniform intervals along a direction in which the terminal chain body 30 is fed. The terminal chain body 30 thus formed is wound up into a reel and then, in this state, is set in the terminal crimping device 100 (not illustrated). Subsequently, each of the crimp terminals 1 is cut off from the terminal chain body 30 after being crimped to the electric wire 50.

The terminal crimping device 100 is described next.

Figure 8:
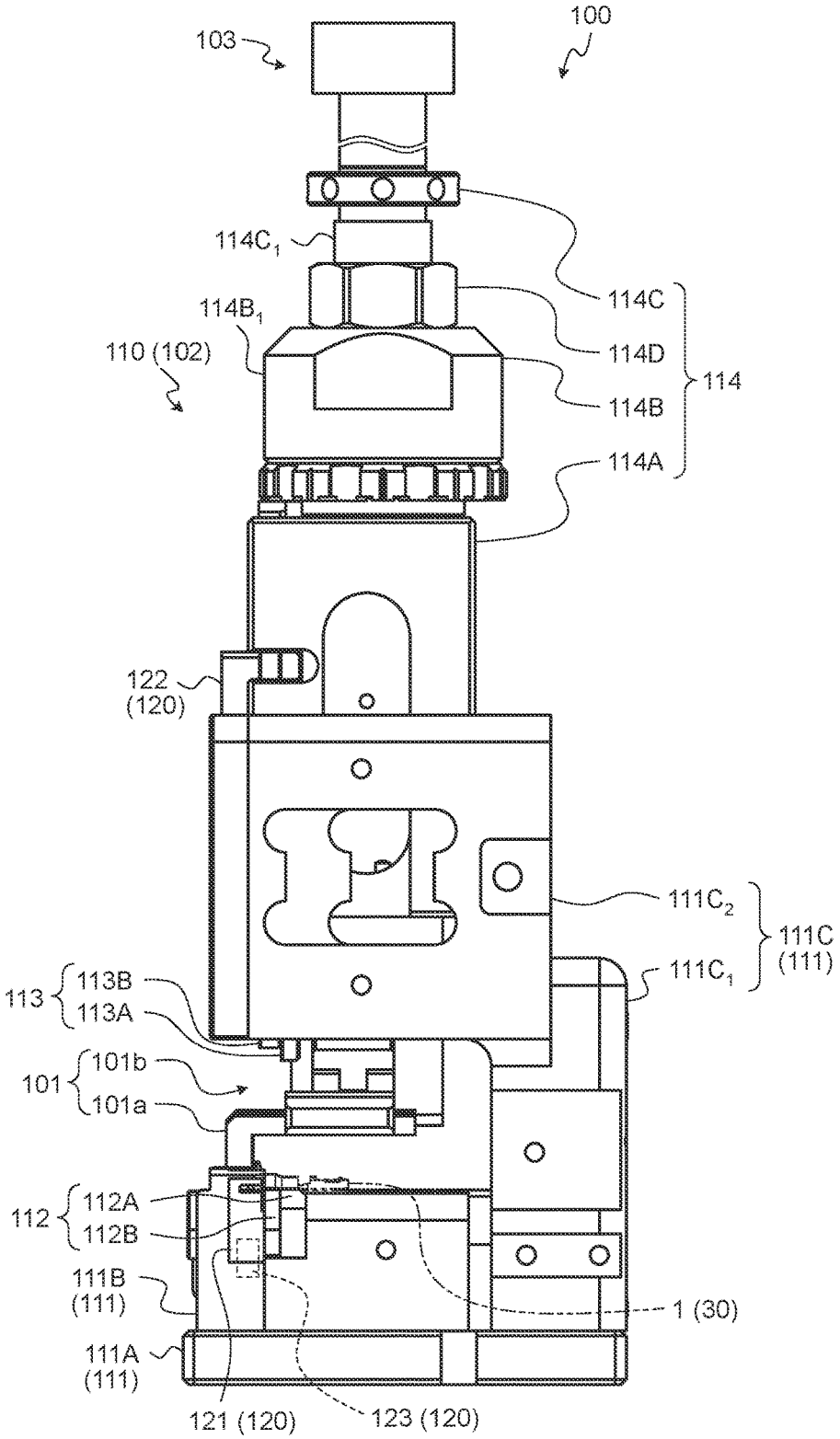
FIG. 8 is a view explaining a terminal crimping device according to the embodiment.

As illustrated in FIG. 8, the terminal crimping device 100 includes: a terminal feeding device 101 that feeds each of the crimp terminals 1 to a certain crimping position; a crimping device 102 that crimps the crimp terminal 1 to the electric wire 50 at the crimping position; and a drive device 103 that drives the terminal feeding device 101 and the crimping device 102. The terminal feeding device 101 and the crimping device 102 form a device called an applicator in this technical field.

The terminal feeding device 101 draws out one that, on the outer circumferential side of the terminal chain body 30 wound up into a reel, comes first among the crimp terminals 1. The terminal feeding device 101 thus sequentially feeds the crimp terminals 1 to the crimping position. After the completion of crimping the first-coming one of the crimp terminals 1 to an electric wire 50 and cutting it off from the terminal chain body 30, the terminal feeding device 101 feeds, to the crimping position, another one that newly comes first among the crimp terminals 1. This terminal feeding device 101 sequentially repeats this operation each time a crimping process and a cutting process are performed.

This terminal feeding device 101 has a configuration that is publicly known in this technical field, and includes: a terminal feeding member 101*a* to be inserted into the terminal feeding hole 31*a* in the connecting piece 31; and a power transmitting mechanism 101*b* that drives the terminal feeding member 101*a* by use of power of the drive device 103. The power transmitting mechanism 101*b* is configured as a linked mechanism that operates in conjunction with crimping operation (vertical moves of components such as a ram 114A to be described later) of the crimping device 102. The terminal feeding device 101 operates in conjunction with the crimping operation of the crimping device 102 to drive the terminal feeding member 101*a* in up-and-down and right-and-left directions, thereby feeding each of the crimp terminals 1 to the crimping position.

The crimping device 102 crimps, to an electric wire 50, each of the crimp terminals 1 that have been fed, and cuts this crimp terminal 1 off from the terminal chain body 30. For that purpose, this crimping device 102 includes a crimping machine 110 and a terminal cutting machine 120.

The crimping machine 110 swages, to an end portion of the electric wire 50, one of the crimp terminals 1 that has been fed to the crimping position, thereby crimping this one of the crimp terminals 1 to the electric wire 50. The crimping machine 110 in this example swages the first barrel piece 15 and the second barrel piece 16 in the crimp terminal 1 to the core wire 51 at the tip and the cover 52, respectively, in the electric wire 50, thereby crimping this crimp terminal 1 to the electric wire 50. This crimping machine 110 includes a frame 111, a first die 112 and a second die 113 that form a pair, and a power transmitting mechanism 114.

The frame 111 includes a base platform 111A, an anvil supporting body 111B, and a supporting body (hereinafter referred to as "transmitter supporting body") 111C for the power transmitting mechanism 114. The base platform 111A is fixed on, for example, a placement platform (not illustrated) on which to mount the terminal crimping device 100. The anvil supporting body 111B and the transmitter supporting body 111C are fixed on the base platform 111A. The transmitter supporting body 111C is arranged nearer to the rear than (in the drawing plane of FIG. 8, to the right of) and higher than (in the drawing plane of FIG. 8, above) the anvil supporting body 111B is. Specifically, this transmitter supporting body 111C has: a standing part 111$C_1$ provided in the rear of the anvil supporting body 111B so as to stand upward from the base platform 111A; and a ram supporting part 111$C_2$ held on the upper part of this standing part 111$C_1$. The ram supporting part 111$C_2$ is a supporting part that supports the ram 114A to be described later, and is arranged above and at a certain distance from the anvil supporting body 111B.

Figure 9:
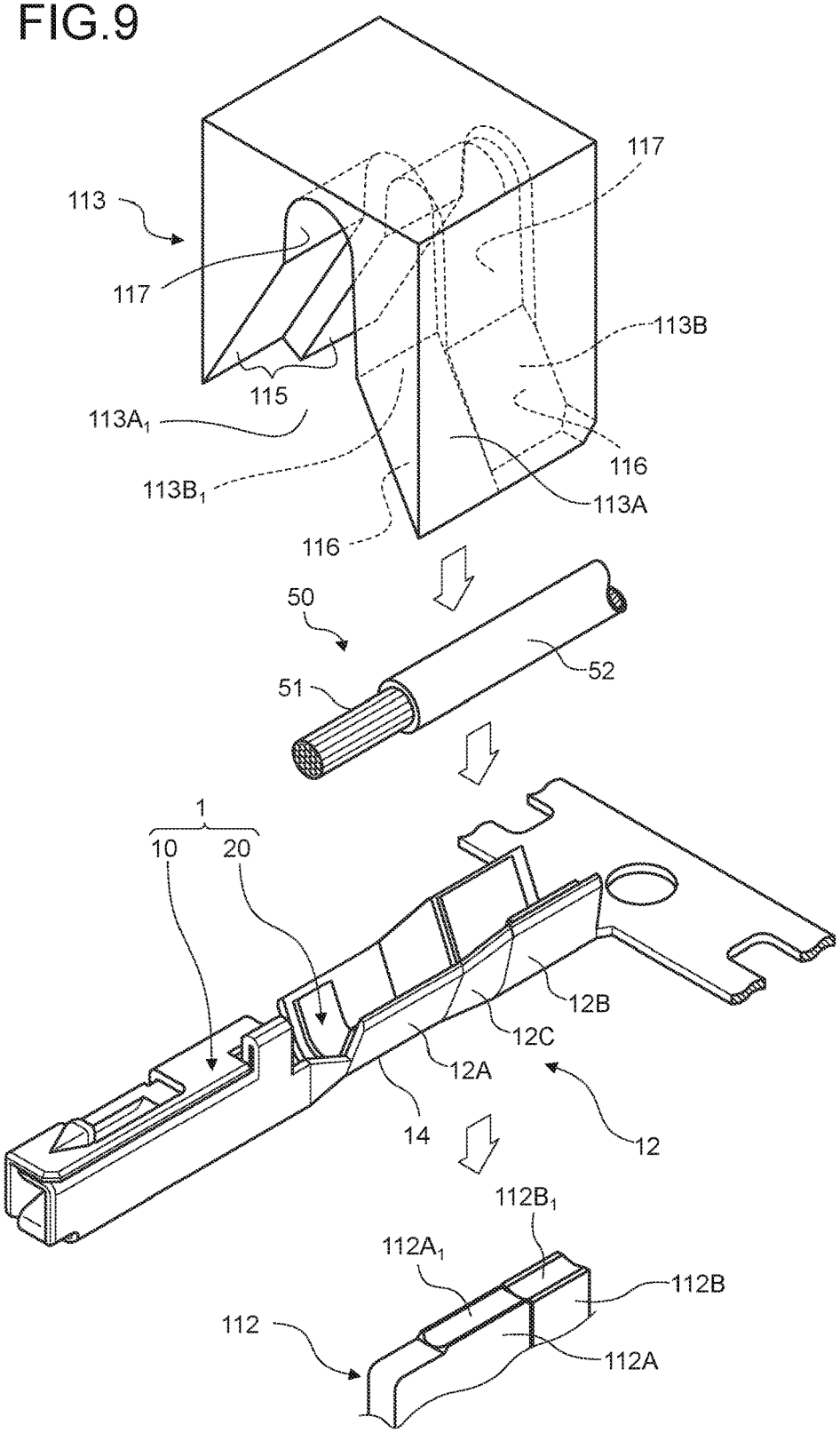
FIG. 9 is a perspective view explaining first and second dies according to the embodiment.

The first die 112 and the second die 113 are arranged at a distance from each other in the vertical direction, and are crimping and forming dies that gradually pinch the crimp terminal 1 and the end portion of the electric wire 50 placed therebetween to crimp the crimp terminal 1 to the end portion of the electric wire 50 (FIG. 9). The first die 112 is obtained by forming two lower dies, and includes a first anvil 112A and a second anvil 112B as the lower dies.

The second die 113 is obtained by forming two upper dies, and includes a first crimper 113A and a second crimper 113B. The first anvil 112A and the first crimper 113A are arranged so as to vertically face each other, and the distance therebetween is decreased, so that the then U-shaped core-wire crimping portion 12A is crimped to the core wire 51 at the tip. The second anvil 112B and the second crimper 113B are also arranged so as to vertically face each other, and the distance therebetween is decreased, so that the then U-shaped cover crimping portion 12B is crimped to the cover 52.

The drive device 103 transmits power thereof to the power transmitting mechanism 114, thereby reducing the distance between the first anvil 112A and the first crimper 113A and the distance between the second anvil 112B and the second crimper 113B during such a crimping process and enlarging the distance between the first anvil 112A and the first crimper 113A and the distance between the second anvil 112B and the second crimper 113B after the crimping process. In this example, the second die 113 is moved upward from and downward to the first die 112, so that the first crimper 113A and the second crimper 113B are collectively moved upward from and downward to the first anvil 112A and the second anvil 112B. Note that the first anvil 112A, the second anvil 112B, the first crimper 113A, and the second crimper 113B may be individually formed compacts, and, in that case, the drive device 103 and the power transmitting mechanism 114 may be configured to move the first crimper 113A and the second crimper 113B upward and downward separately. In this example, after crimping of the core-wire crimping portion 12A using the first anvil 112A and the first crimper 113A is started, crimping of the cover crimping portion 12B using the second anvil 112B and the second crimper 113B is started.

The power transmitting mechanism 114 according to this embodiment is configured to transmit, to the first crimper 113A and the second crimper 113B, power output from the drive device 103, and includes the ram 114A, a ram bolt 114B, and a shank 114C as illustrated in FIG. 8.

The ram 114A is a movable member upward and downward movably supported relative to the ram supporting part 111$C_2$. The second die 113 is fixed to this ram 114A. The first crimper 113A and the second crimper 113B are thus enabled to move upward from and downward to the ram supporting part 111$C_2$, integrally with the ram 114A. For example, this ram 114A is formed in a rectangular parallelepiped shape. This ram 114A has a female screw part (not illustrated) formed therein. The female screw part is formed in the inner circumferential surface of a vertically extending hole formed from the interior of the ram 114A toward the upper end surface thereof.

The ram bolt 114B has a male screw part (not illustrated) to be screwed into the female screw part of the ram 114A. This ram bolt 114B is thus enabled to move upward from and downward to the ram supporting part 111$C_2$, integrally with the ram 114A. This ram bolt 114B also has a bolt head 114$B_1$ arranged above the male screw part thereof. The bolt head 114$B_1$ has a female screw part (not illustrated) formed therein. The female screw part is formed in the inner circumferential surface of a vertically extending hole formed from the interior of the bolt head 114$B_1$ toward the upper end surface thereof.

The shank 114C is a cylindrical hollow member and has a male screw part 114$C_1$ and a connection part (not illustrated) at opposite end portions thereof. The male screw part 114$C_1$ of this shank 114C is formed under the hollow member, and is screwed into the female screw part of the bolt head 114$B_1$ in the ram bolt 114B. The shank 114C is thus enabled to move upward from and downward to the ram supporting part 111$C_2$, integrally with the ram 114A and the ram bolt 114B. The connection part is connected to the drive device 103.

The drive device 103 has a drive source (not illustrated) and a power conversion mechanism (not illustrated) that converts drive force of the drive source into upward and downward power. The connection part of the shank 114C is joined to an output shaft of this power conversion mechanism. The output of the drive device 103 (the output of the power conversion mechanism) thus causes the first crimper 113A and the second crimper 113B to move upward from and downward to the ram supporting part 111$C_2$, integrally with the ram 114A, the ram bolt 114B, and the shank 114C. Examples applicable to the drive force include an electrical actuator such as an electrical motor, an hydraulic actuator such as a hydraulic cylinder, a pneumatic actuator such as an air cylinder, or the like.

Here, the vertical position of the first crimper 113A relative to the first anvil 112A and the vertical position of the second crimper 113B relative to the second anvil 112B can be changed through adjustment of how deep the male screw part 114$C_1$ of the shank 114C is screwed into the female screw part of the bolt head 114$B_1$. A nut 114D is screwed onto the male screw part 114$C_1$ of the shank 114C above the ram bolt 114B, and the nut 114D and the female screw part of the bolt head 114$B_1$ collectively function as what is called a locking nut. Thus, the first crimper 113A and the second crimper 113B can be fixed at these relative positions by fastening this nut 114D toward the ram bolt 114B after the completion of adjustment of the above relative positions.

The first anvil 112A and the second anvil 112B have downward-concaved concave surfaces 112$A_1$ and 112$B_1$, respectively, at the respective upper leading ends thereof (FIG. 9). The respective concave surfaces 112$A_1$ and 112$B_1$ are formed in an arc-like shape so as to follow the shapes of portions of the bottom portion 14 that correspond to the core-wire crimping portion 12A shaped in a U letter and the cover crimping portion 12B shaped in a U shape. In this crimping machine 110, these concave surfaces 112$A_1$ and 112$B_1$ serve as the crimping position. In the crimp terminal 1 that has been fed with the bottom portion 14 thereof facing downward, the portion of the bottom portion 14 corresponding to the core-wire crimping portion 12A is placed on the concave surface 112$A_1$ at the upper end of the first anvil 112A, and the portion of the bottom portion 14 corresponding to the cover crimping portion 12B is placed on the concave surface 112$B_1$ at the upper end of the second anvil 112B. The first die 112 is supported by the anvil supporting body 111B with these concave surfaces 112$A_1$ and 112$B_1$ exposed upward.

The first crimper 113A and the second crimper 113B have upward-concaved concave portions 113$A_1$ and 113$B_1$, respectively, formed therein (FIG. 9). The concave portions 113$A_1$ and 113$B_1$ are arranged so as to vertically face the respective concave surfaces 112$A_1$ and 112$B_1$ of the first anvil 112A and the second anvil 112B. The respective concave portions 113$A_1$ and 113$B_1$ have a first and second wall surfaces 115 and 116 facing each other, and a third wall surface 117 that connect together the upper ends of the first and the second wall surfaces 115 and 116. The concave portions 113$A_1$ and 113$B_1$ swage the first barrel piece 15 and the second barrel piece 16 to the end portion of the electric wire 50 with these barrel pieces wrapped around the end portion while bringing the first to the third wall surfaces 115 to 117 into contact with the first barrel piece 15 and the second barrel piece 16. The concave portions 113$A_1$ and 113$B_1$ are formed so that such swaging operation can be implemented.

The crimp terminal 1 is cut off from the connecting piece 31 by the terminal cutting machine 120 after being subjected to a crimping process by the crimping machine 110 as described above. The terminal cutting machine 120 is configured to cut the bridging part 32 of the crimp terminal 1 fed to the crimping position by pinching the bridging part 32 between two terminal cutting parts, and performs this cutting concurrently with the progress of the crimping process. The terminal cutting machine 120 is arranged nearer to the front than (in the drawing plane of FIG. 8, to the left of) the second anvil 112B is. The terminal cutting machine 120 includes a terminal cutting body 121, a downward pressing member 122, and an elastic member 123.

Figure 10:
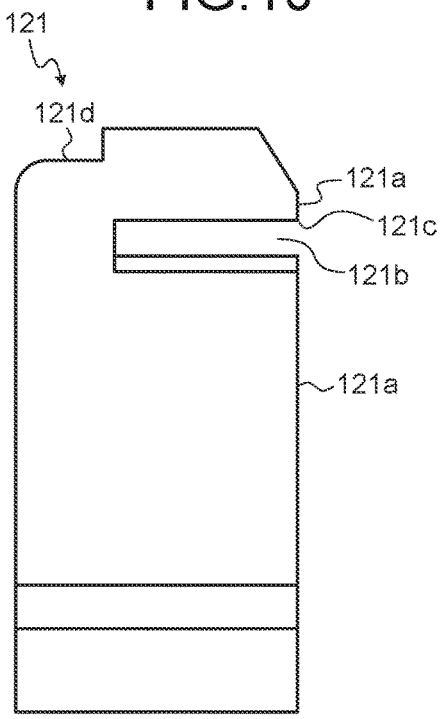
FIG. 10 is a side view illustrating a terminal cutting body according to the embodiment.
Figure 11:
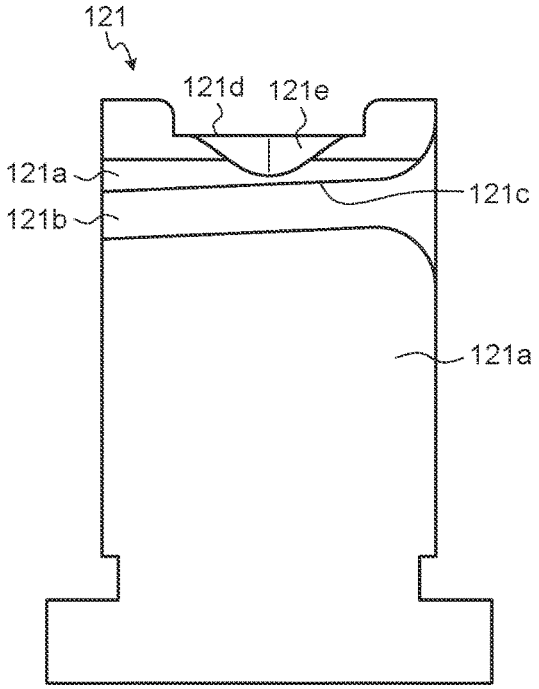
FIG. 11 is a back view illustrating the terminal cutting body according to the embodiment.
Figure 12:
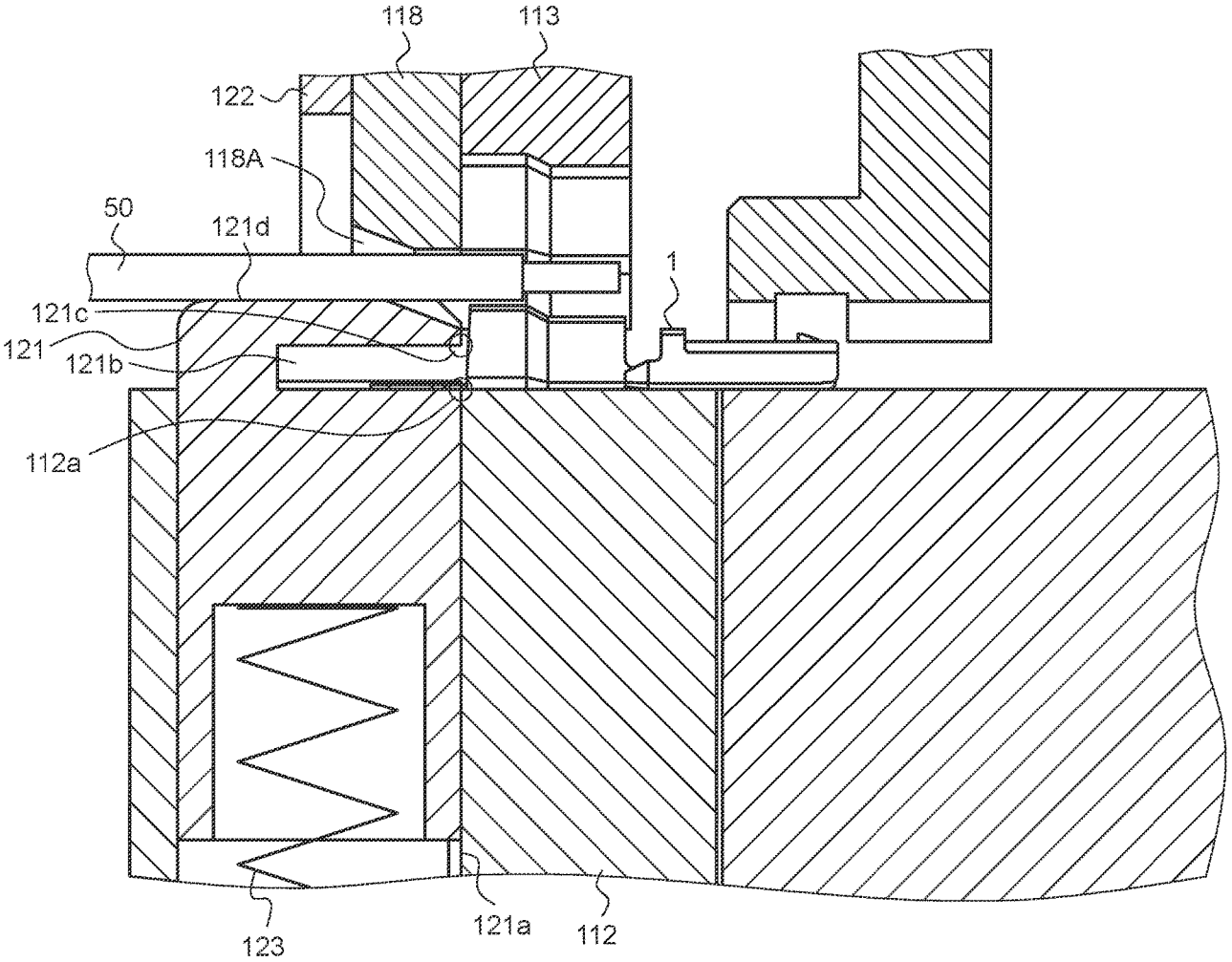
FIG. 12 is a view explaining a state in which the crimp terminal and the electric wire have been set in the terminal crimping device.

The terminal cutting body 121 is formed in a rectangular parallelepiped shape, and is arranged so as to be upward and downward slidable along the frontward surface of the second anvil 112B. In this terminal cutting body 121, a slit 121*b* is formed toward the interior from a sliding contact surface 121*a* thereof that makes sliding contact with the second anvil 112B (FIG. 10 and FIG. 11). The slit 121*b* is an interior space into which the connecting piece 31 is inserted when the crimp terminal 1 to be crimped has been fed to the crimping position. Here, the connecting piece 31 is inserted with a part of one of the bridging parts 32 being projected, the one being coupled with this crimp terminal 1. Here, the position of the terminal cutting body 121 that allows insertion of the connecting piece 31 and the like into the slit 121*b* is defined as an initial vertical position thereof. An end portion of the bridging part 32 that faces the electric-wire connecting portion 12 is projected from the inside of the slit 121*b* through an opening of the slit 121*b* at the sliding contact surface 121*a* side (that is, the side facing the crimp terminal 1) (FIG. 12). In the terminal cutting body 121, an upper edge portion (hereinafter referred to as "opening edge") 121*c* at the opening is utilized as one of the terminal cutting parts.

The downward pressing member 122 is fixed to the ram 114A, and moves upward and downward integrally with the ram 114A. This downward pressing member 122 is arranged above the terminal cutting body 121, and presses down the terminal cutting body 121 by moving downward. The downward pressing member 122 is formed in a rectangular parallelepiped shape. The elastic member 123 is configured to apply force that biases the terminal cutting body 121 upward thereto, and is constructed of members such as a spring member. This elastic member 123 returns the terminal cutting body 121 to an initial position thereof in the vertical direction when downward pressing force from the downward pressing member 122 is removed.

In this terminal cutting machine 120, the downward move of the second die 113 during a crimping process is accompanied by the downward move of the downward pressing member 122, which presses down the terminal cutting body 121, so that the bridging part 32 is inserted between the opening edge 121*c* of the slit 121*b* and an upper surface edge 112*a* (FIG. 12) serving as the other one of the two terminal cutting parts in the second anvil 112B. In this terminal cutting machine 120, these opening edge 121*c* and upper surface edge 112*a* act like scissors. Thus, in this terminal cutting machine 120, when the terminal cutting body 121 is further pressed down, the opening edge 121*c* and the upper surface edge 112*a* cuts the bridging part 32, thereby cutting the crimp terminal 1 off from the terminal chain body 30. In order to enhance the cutting performance, the opening edge 121*c* is tilted to the upper surface edge 112*a* on the sliding contact surface 121*a*.

The electric wire 50 subject to the crimping is arranged at a certain position between the terminal cutting body 121 and the downward pressing member 122 (FIG. 12). The electric wire 50 is, specifically, placed on an upper surface 121*d* of the terminal cutting body 121. For this reason, a space into which the electric wire 50 can be escaped is provided in at least one of the upper part of the terminal cutting body 121 and the lower part of the downward pressing member 122 in order to prevent the electric wire 50 from crushing these parts.

Here, the certain position means a position such that the end portion of the electric wire 50 before a crimping process is placed above the bottom portion 14 of the then flat plate-shaped electric-wire connecting portion 12 and such that the core wire 51 can be placed on a portion of the bottom portion 14 that corresponds to the core-wire crimping portion 12A in a manner that, when the core wire 51 at the tip is pressed down at the same time as the crimping process starts, prevents the forefront position of the tip from protruding outside the core-wire crimping portion 12A. During the crimping process, the forefront position of the core wire 51 at the tip may possibly elongate in the axial direction thereof beyond a position at which it is placed. It is desirable that such elongation be taken into account in determination of the certain position.

Figure 13:
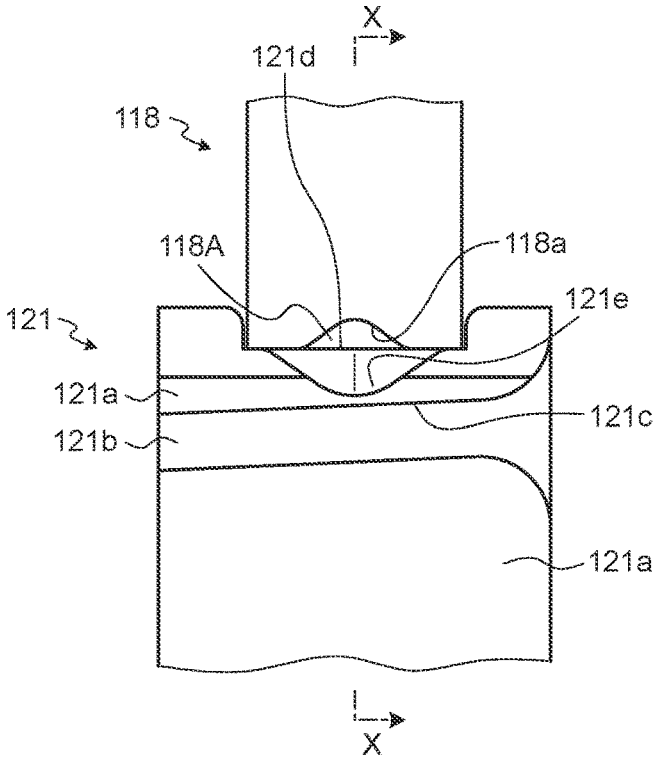
FIG. 13 is a view explaining an electric-wire holding mechanism.
Figure 14:
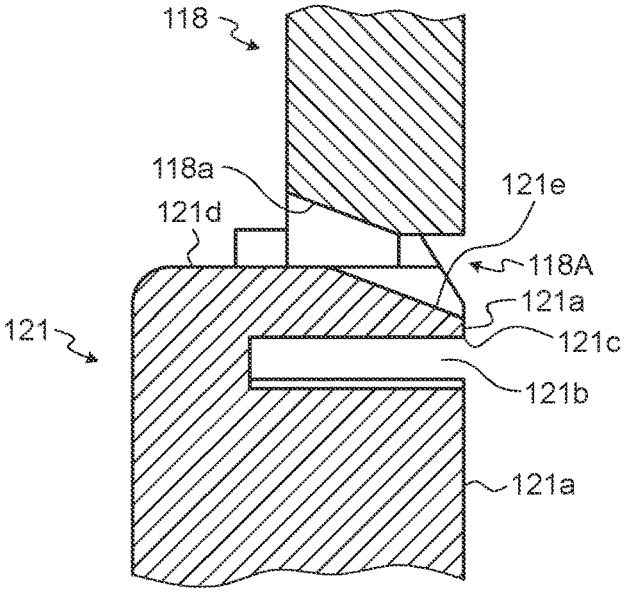
FIG. 14 is a sectional view illustrating the electric-wire holding mechanism taken along the line X-X in FIG. 13.

At the same time, the end portion (the core wire 51 at the tip and the cover 52) of the electric wire 50 is pressed down by the second die 113 toward the inner wall surface of the electric-wire connecting portion 12, and may be lifted up from the upper surface 121*d* of the terminal cutting body 121 without any component that holds the end portion. It is therefore likely that the core wire 51 at the tip and the cover 52 are subjected to crimping without being placed on the bottom portion 14 of the electric-wire connecting portion 12. For this reason, the terminal crimping device 100 according to this embodiment includes an electric-wire holding mechanism that holds the electric wire 50 at the certain position between itself and the upper part of the terminal cutting body 121 to prevent the end portion of the electric wire 50 from being displaced relative to the electric-wire connecting portion 12 during a crimping process. The electric-wire holding mechanism includes an electric-wire presser 118 that holds the electric wire 50 placed on the upper surface 121*d*, serving as an electric-wire placing portion, of the terminal cutting body 121 by pressing the electric wire 50 toward and against the upper surface 121*d* (FIG. 12). The electric-wire presser 118 is arranged above the terminal cutting body 121 and between the second die 113 and the downward pressing member 122. A space (hereinafter referred to as "electric-wire holding space") 118A to hold the cover 52 of the electric wire 50 is formed between the upper surface 121*d* of the terminal cutting body 121 and a lower surface of the electric-wire presser 118 (FIG. 13 and FIG. 14). The electric-wire holding space 118A prevents uplift of the electric wire 50 from the upper surface 121*d* of the terminal cutting body 121 during a crimping process, thereby preventing the core wire 51 at the tip and the cover 52 from being displaced relative to the electric-wire connecting portion 12. The electric-wire presser 118 is configured to be able to move upward from and downward to the upper surface 121*d* of the terminal cutting body 121, and forms the electric-wire holding space 118A between itself and the upper part of the terminal cutting body 121 by moving downward. The electric-wire presser 118 is fixed to, for example, the ram 114A and moves upward and downward integrally with the ram 114A. The electric wire 50 is held by the electric-wire holding space 118A formed by the downward move of the electric-wire presser 118.

At the crimping, the electric wire 50 is pressed down by the second die 113 toward the bottom portion 14 of the electric-wire connecting portion 12, sequentially from one side thereof having the core wire 51 at the tip, so that a crimping process location gradually shifts from the core-wire crimping portion 12A to the cover crimping portion 12B. Thus, by being pressed down by the second die 113, the end portion of the electric wire 50 is declined toward the bottom portion 14 of the electric-wire connecting portion (downward) from the base end thereof (a boundary portion between the terminal cutting body 121 and the first and second dies 112 and 113). Here, in the electric wire 50, when a bend occurs between a portion thereof being held by the electric-wire holding space 118A and a portion thereof being pressed by the second die 113, a portion with the bend comes under load, and it is likely that the load can be one of the factors that impair durability. Furthermore, in this electric wire 50, despite prevention of uplift thereof from the upper surface 121*d* of the terminal cutting body 121, it is likely that the load acting on the portion with the bend can be a factor that displaces the core wire 51 at the tip and the cover 52 relative to the electric-wire connecting portion 12. It is likely that the displacement causes the core wire 51 at the tip to protrude outside the electric-wire connecting portion 12.

For this reason, in the terminal crimping device 100 according to this embodiment, the electric-wire holding space 118A is inclined in the same direction as one in which the end portion of the electric wire 50 that has been declined by being pressed down extends. This terminal crimping device 100 is thus enabled to reduce the load acting on the electric wire 50 between a portion thereof being held by the electric-wire holding space 118A and a portion thereof being pressed down by the second die 113. This terminal crimping device 100 is thus enabled to keep the durability of the electric wire 50 from being impaired. Furthermore, this terminal crimping device 100 uses the electric-wire holding space 118A to prevent uplift of the electric wire 50 from the upper surface 121*d* of the terminal cutting body 121 at the same time as reducing the load acting on the electric wire 50 during a crimping process, thereby preventing the core wire 51 at the tip and the cover 52 from being displaced relative to the electric-wire connecting portion 12. Therefore, this terminal crimping device 100 allows for a desired crimping process using the electric-wire holding space 118A, thereby allowing for improvement in crimping process accuracy.

Here, it is desirable that the inclination angle of the electric-wire holding space 118A be set equal or approximate to the inclination angle of the end portion of the electric wire 50 with respect to a portion of the bottom portion 14 of the electric-wire connecting portion 12 during a crimping process. In addition, when the inclination angle of the end portion of the electric wire 50 variously changes during a crimping process, it is desirable that the inclination angle of the electric-wire holding space 118A be set equal or approximate to any one of various inclination angles taken by the end portion. For example, the inclination angle of the electric-wire holding space 118A is set equal to an inclination angle to be taken by the end portion of the electric wire 50 when the core wire 51 at the tip makes contact with the bottom portion 14 of the electric-wire connecting portion 12. The terminal crimping device 100 according to this embodiment can appropriately reduce a load acting on the electric wire 50 by thus setting the inclination angle of the electric-wire holding space 118A.

Figure 15:
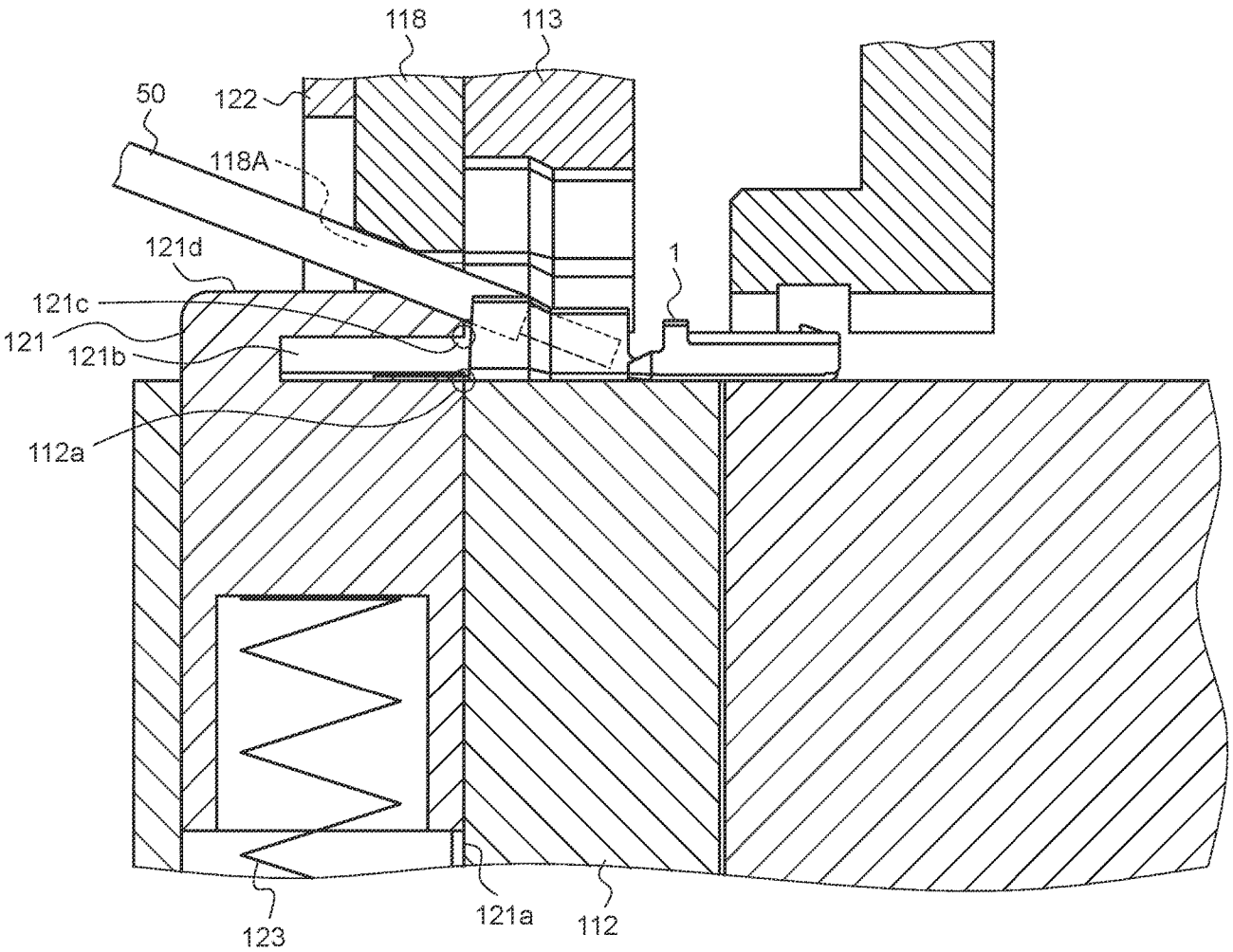
FIG. 15 is a view explaining a state of the electric wire when it is held by the electric-wire holding mechanism.

Specifically, the electric-wire holding space 118A is composed of a recessed portion 121*e* formed in the upper surface 121*d* of the terminal cutting body 121 and a recessed portion 118*a* formed in the lower surface of the electric-wire presser 118. The recessed portion 121*e* in the terminal cutting body 121 is, for example, a V-shaped groove having side walls the distance between which increases while approaching the lower surface of the electric-wire presser 118, and having a groove bottom inclined so as to be more distant from the lower surface of the electric-wire presser 118 while approaching the end portion (the tip) of the electric wire 50. The recessed portion 118*a* in the electric-wire presser 118 is, for example, a V-shaped groove having side walls the distance between which increases while approaching the upper surface 121*d* of the terminal cutting body 121, and having a groove bottom inclined so as to be nearer to the upper surface 121*d* of the terminal cutting body 121 while approaching the end portion (the tip) of the electric wire 50. It is desirable that the groove bottoms of the respective recessed portions 121*e* and 118*a* be formed, for example, so as to have the same inclination angle with respect to the upper surface 121*d* of the terminal cutting body 121. The electric wire 50 is inserted and pinched between the recessed portions 121*e* and 118*a* and thereby inclined in the same direction as the inclination of the end portion of the electric wire 50 that is declined when being pressed downward. The electric wire 50 is then held by the electric-wire holding space 118A while being thus inclined (FIG. 15).

Here, in this terminal crimping device 100, it is desirable that, before a crimping process actually starts (the first barrel piece 15 and the second barrel piece 16 take contact with the first wall surface 115 and the second wall surface 116) or at the same time as a crimping process actually starts, the electric-wire presser 118 be moved downward so that the electric wire 50 can be located at the certain position and held by the electric-wire holding space 118A. Thus, in this terminal crimping device 100, when a crimping process has actually started, the core wire 51 is placed on a portion of the bottom portion 14 corresponding to the core-wire crimping portion 12A in a manner preventing the forefront position of the core wire 51 at the tip from protruding outside the core-wire crimping portion 12A, which enables further prevention of the end portion of the electric wire 50 from being displaced relative to the electric-wire connecting portion 12.

In this electric-wire holding space 118A, the respective recessed portions 118*a* and 121*e* are formed in V-shapes the openings of which face each other. Therefore, whether or not the electric wire 50 is displaced along the upper surface 121*d* of the terminal cutting body 121 before being held, the electric wire 50 can be guided to the groove bottoms of the respective recessed portions 121*e* and 118*a* in line with the downward move of the electric-wire presser 118. Consequently, the terminal crimping device 100 according to this embodiment can hold the electric wire 50 at the certain position by use of this electric-wire holding space 118A whether or not the electric wire 50 has been displaced along the upper surface 121*d* of the terminal cutting body 121.

Figure 16:
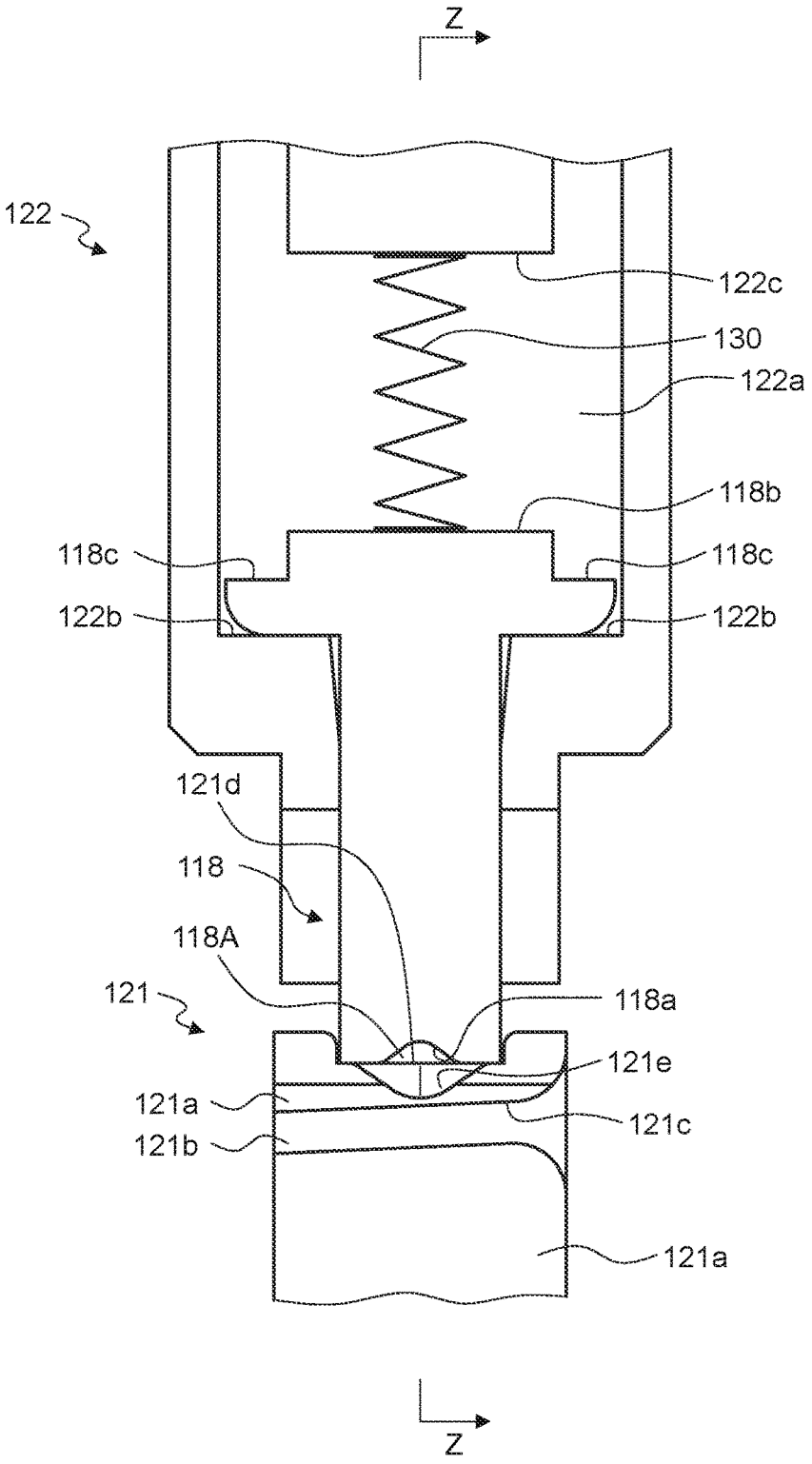
FIG. 16 is a back view illustrating a terminal cutting body in another embodiment in the embodiment.
Figure 17:
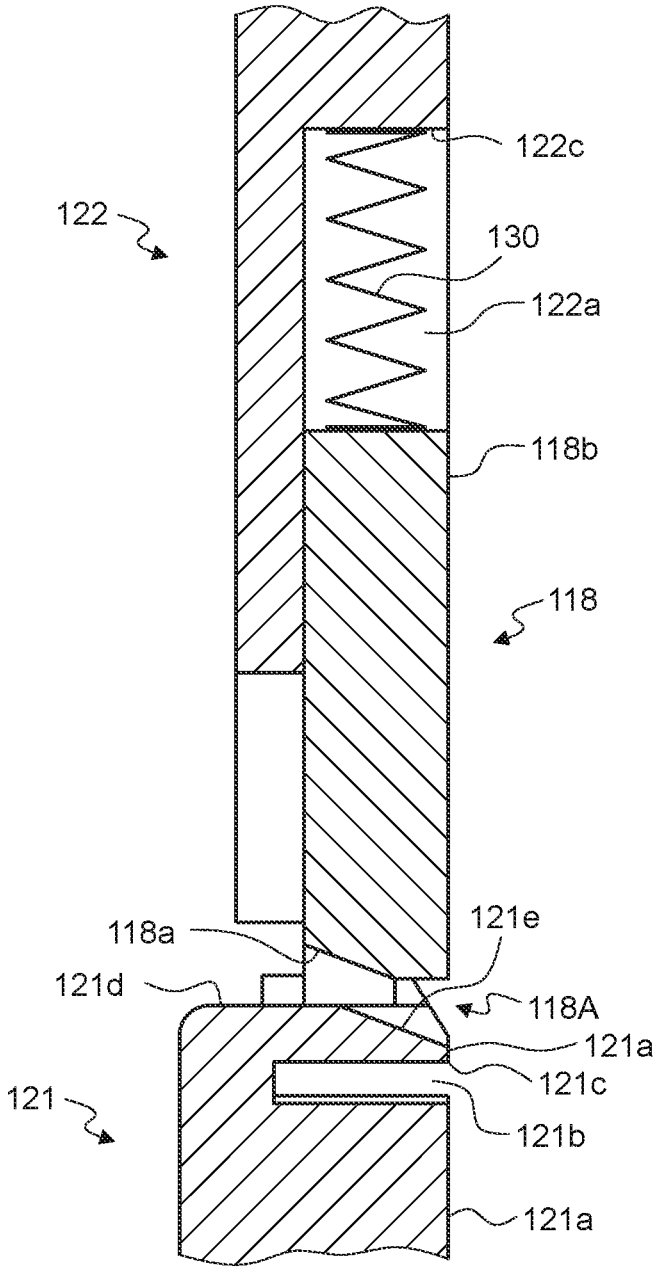
FIG. 17 is a sectional view of the terminal cutting body taken along the line Z-Z in FIG. 16.

Alternatively, in this terminal crimping device 100, the electric-wire presser 118 may be arranged so as to be able to accommodate an upper part 118*b* thereof in a space 122*a* in the interior of the downward pressing member 122 and move vertically relative to the downward pressing member 122 (in directions in which the ram 114A moves upward and downward) (FIG. 16 and FIG. 17). The configuration described here makes it possible that: with the electric wire 50 being held by the electric-wire holding space 118A, when reactive force from the electric wire 50 acts on the electric-wire presser 118 in a direction reverse to the pressing direction, the electric-wire presser 118 moves upward relative to the downward pressing member 122, so that the force acting on the electric wire 50 is relieved. Therefore, the electric wire 50 is prevented from being deformed at the position where it is held by the electric-wire holding space 118A, thereby having improved durability.

Here, it is desirable that the electric-wire presser 118 in this case include overhanging parts 118*c* that is caught and stopped so as to stop the electric-wire presser 118 from further moving downward relative to the downward pressing member 122 (FIG. 16). The overhanging parts 118*c* are formed, for example, on the upper part 118*b* of the electric-wire presser 118, and are caught and stopped by a lower wall part 122*b* of an interior space 122*a* of the downward pressing member 122. In this case, the position of the electric-wire presser 118 that is caught and stopped when the overhanging parts 118*c* are caught and stopped is defined as an initial position of the electric-wire presser 118 relative to the downward pressing member 122. It is also desirable that an elastic member 130 such as a helical spring be interposed between an upper wall part 122*c* of the space 122*a* and the upper part 118*b* of the electric-wire presser 118 in the interior space 122*a* of the downward pressing member 122. By use of this elastic member 130, the electric-wire presser 118 receives upward-acting force at the recessed portion 118*a*, and, even when having moved vertically relative to the downward pressing member 122, can return to the initial position when the force stops acting thereon.

Modification

Figure 18:
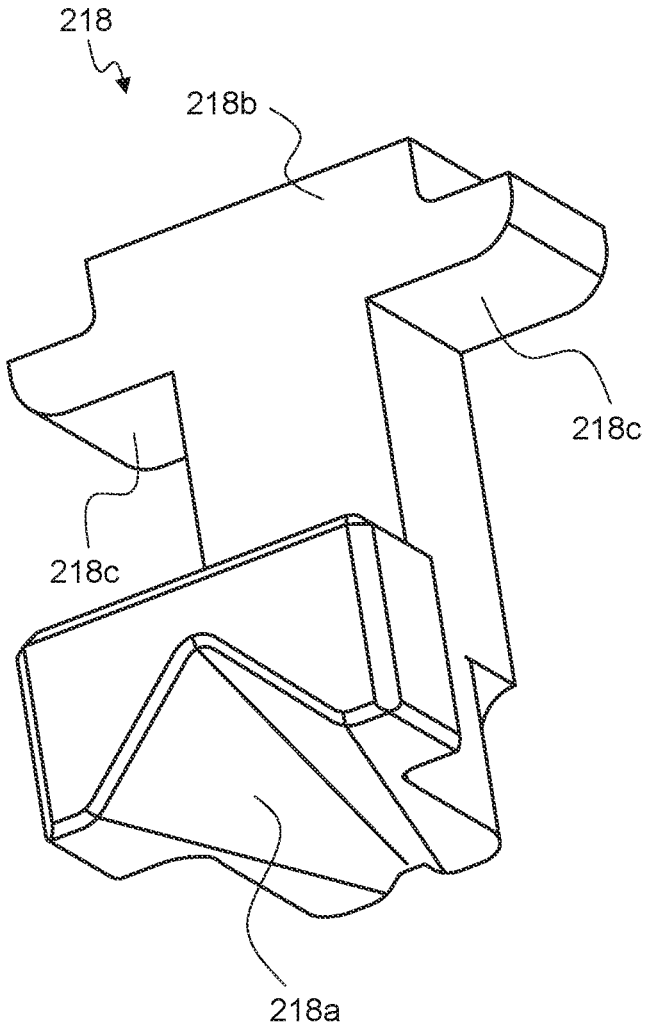
FIG. 18 is a perspective view illustrating an electric-wire presser according to a modification.
Figure 19:
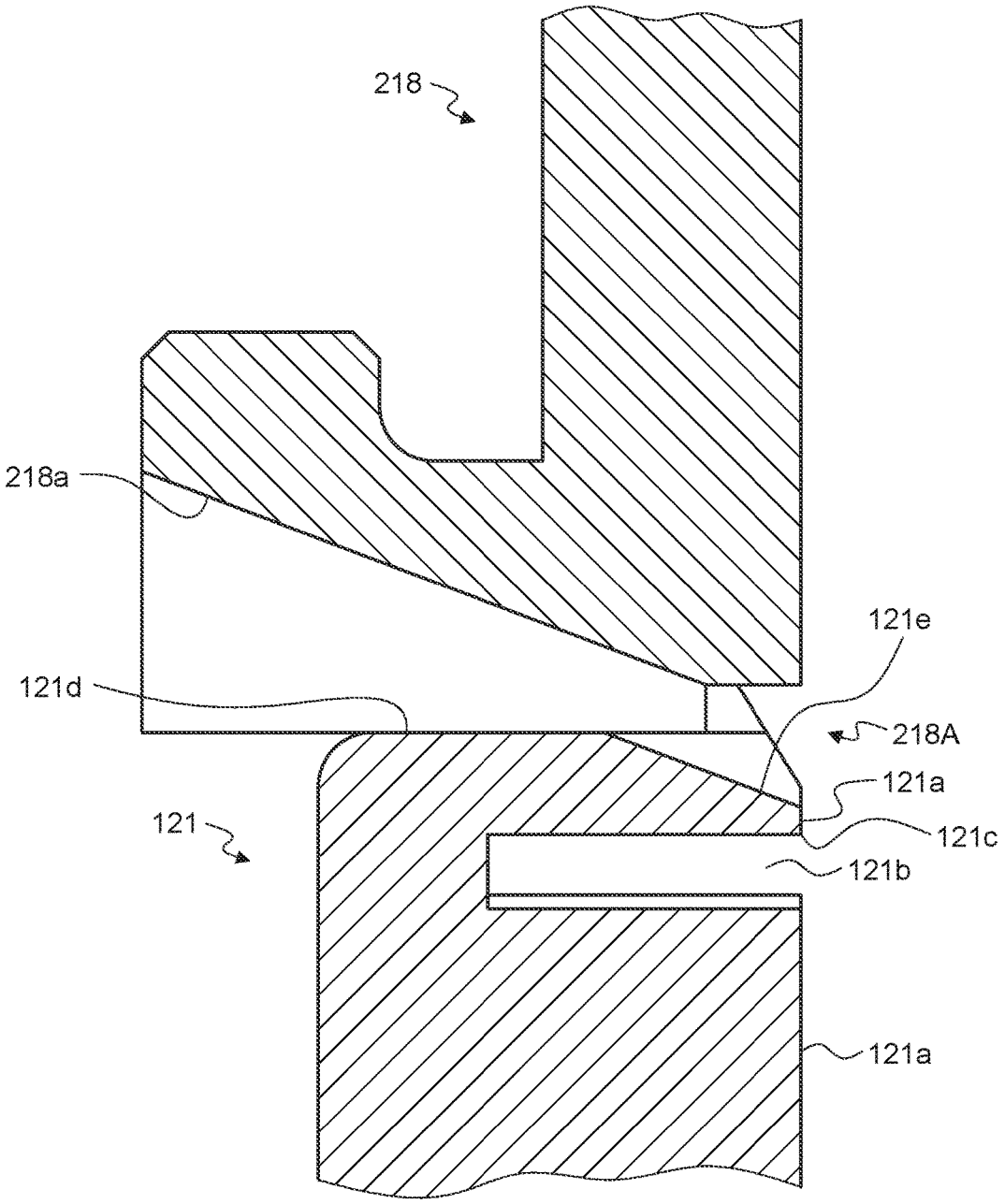
FIG. 19 is a view explaining an electric-wire holding mechanism according to the modification.

This modification is obtained by modifying the electric-wire holding space 118A is modified into an electric-wire holding space 218A described below (FIG. 19) as a result of replacement of the electric-wire presser 118 with an electric-wire presser 218 described below (FIG. 18) in the terminal crimping device 100 in the embodiment.

The electric-wire presser 218 according to this modification has a recessed portion 218*a* in the lower surface thereof as in the case of the electric-wire presser 118 according to the embodiment. The recessed portion 218*a* forms the electric-wire holding space 218A together with the recessed portion 121*e* of the terminal cutting body 121, and has a groove bottom inclined with respect to the upper surface 121*d* of the terminal cutting body 121 in accordance with the inclination angle of the electric-wire holding space 218A. In this example also, the recessed portion 218*a* in the electric-wire presser 218 is formed as a V-shaped groove.

Here, in the electric-wire holding space 218A, when lengths of the groove bottoms of the recessed portion 121*e* in the terminal cutting body 121 and the recessed portion 218*a* in the electric-wire presser 218 (the length of a held portion of the electric wire 50 in the axial line direction thereof) are short, it is likely that: the electric wire 50 cannot be held at an inclination angle set so that the electric wire 50 can follow the inclined state of the end portion of the electric wire 50 even when the electric wire 50 is pressed down, sequentially from one side thereof having a core wire 51 exposed at a tip thereof, toward the bottom portion 14 of the electric-wire connecting portion 12 by the second die 113, and the electric wire 50 is declined. For this reason, the terminal crimping device 100 according to this modification is configured in such a manner that at least one of the respective groove bottoms of the recessed portion 121*e* in the terminal cutting body 121 and the recessed portion 218*a* in the electric-wire presser 218 is extended. As a result, as compared with the equivalent thereof according to the embodiment, the electric wire 50 can be more reliably held in accordance with the inclination angle of the electric-wire holding space 218A formed by these groove bottoms.

In the terminal crimping device 100 according to this modification, however, when the groove bottom of the recessed portion 121*e* in the terminal cutting body 121 is extended, it is inevitable that, for example, the reference position (which is a position on a portion other than the recessed portion 121*e* and forming a flat surface in the vertical direction, and is a position of a portion on which the electric wire 50 is placed before being pressed to move by the second die 113) on the upper surface 121*d* of the terminal cutting body 121 be raised to an upper position. Consequently, in this case, the electric wire 50 is placed on the upper surface 121*d* at a position more apart from the electric-wire connecting portion 12 as a result of that extension of the groove bottom of the recessed portion 121*e*, and therefore cannot be placed at a desired position relative to the electric-wire connecting portion 12 without making a projected length into a part corresponding to the first die 112 and the second die 113 longer than the electric-wire holding space 218A. The reason of this is as follows: in this terminal crimping device 100, the crimp terminal 1 is held by a terminal presser 119 with a rectangular parallelepiped space (a terminal holding part) 119*a*, which makes it difficult to change the position of the crimp terminal 1 and therefore makes it necessary to handle the situation by changing the position of the electric wire 50 in order to align the crimp terminal 1 and the electric wire 50 when a crimping process is performed. Furthermore, the length of a portion that is not held by the electric-wire holding space 218A is longer than otherwise in the end portion of the electric wire 50, which makes is likely that, when a crimping process is performed, the electric wire 50 is displaced relative to the electric-wire connecting portion 12. Therefore, the groove bottom of the recessed portion 218*a* in the electric-wire presser 218 is extended (FIG. 19) in this modification.

The recessed portion 218*a* in this example is obtained by being extended in a direction away from the position of the second die 113, as compared with the recessed portion 118*a* in the electric-wire presser 118 according to the embodiment. The length of the groove bottom of this recessed portion 218*a* is set to a length that causes the electric wire 50 to be held in a desired inclined state by the electric-wire holding space 218A when the electric wire 50 is pressed down, sequentially from one side thereof having the core wire 51 at the tip, toward the bottom portion 14 of the electric-wire connecting portion 12 by the second die 113. In the terminal crimping device 100 according to this modification, the electric wire 50 is more reliably held in a desired inclined state by the electric-wire holding space 218A (FIG. 20), which allows for more reliable reduction of a load acting on the electric wire 50 between a portion thereof being held by the electric-wire holding space 218A and a portion thereof being pressed down by the second die 113. Consequently, reduction in durability of the electric wire 50 is more reliably avoided. In addition, in this terminal crimping device 100, the electric-wire holding space 218A more reliably prevents the core wire 51 at the tip and the cover 52 from being displaced with respect to the electric-wire connecting portion 12 during a crimping process, which allows for further improvement in crimping process accuracy. Therefore, in the crimp terminal 1, the water stop member 20 is placed at a desired position during a crimping process, which allows for further improvement in water stop performance. Furthermore, in this terminal crimping device 100, the electric wire 50 is more reliably held in a desired inclined state by the electric-wire holding space 218A, and the extent to which the electric wire 50 is lifted up from the bottom portion 14 of the electric-wire connecting portion 12 is thus suppressed during a crimping process. Consequently, undesirable events such as crosswise insertion of the core wire 51 and biting of the cover 52 due to the leading end 15*a* of the first barrel piece 15 or the leading end 16*a* of the second barrel piece 16 can be prevented from occurring. Therefore, the terminal crimping device 100 according to this modification is capable of wrapping the first barrel piece 15 and the second barrel piece 16 around the electric wire 50 during a crimping process, and allows for improvement in crimping process accuracy also in this aspect, thereby contributing to improvement in water stop performance.

Figure 20:
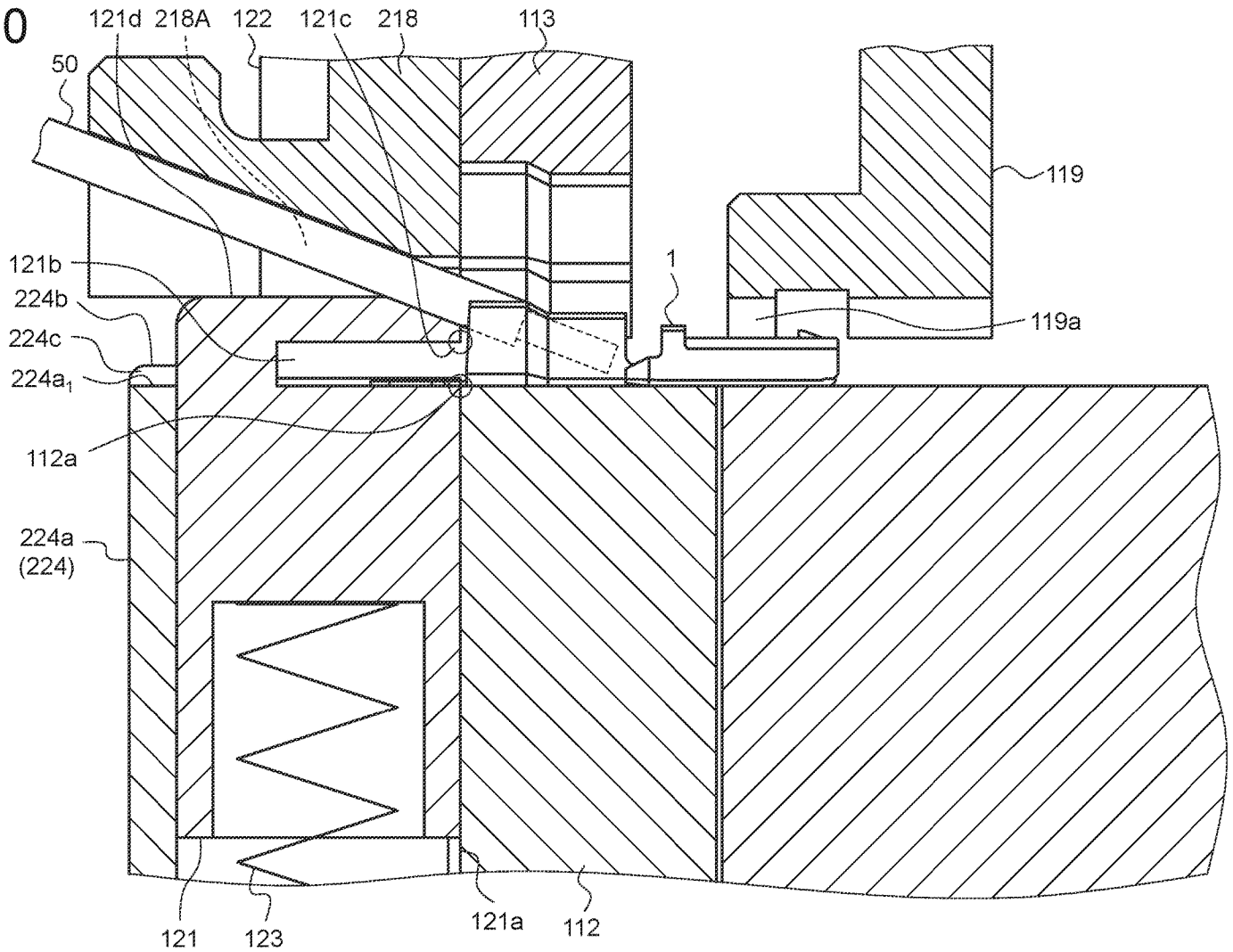
FIG. 20 is a view explaining a state of an electric wire when it is held by the electric-wire holding mechanism according to the modification.
Figure 21:
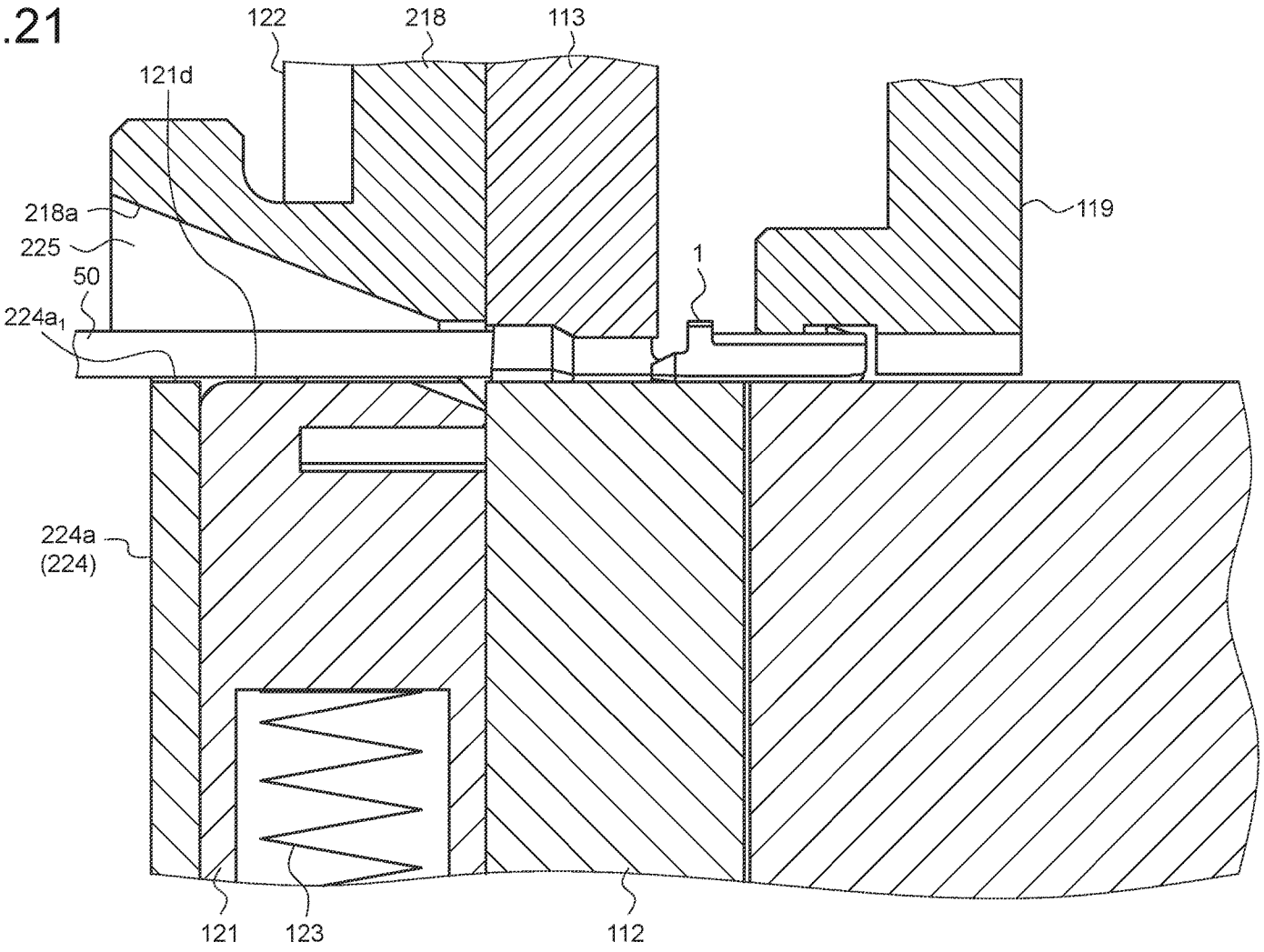
FIG. 21 is a view explaining a state in a terminal crimping device according to the modification at the completion of a crimping process.

Apart from this, the terminal crimping device 100 according to this modification further includes a holding body 224 that holds the terminal cutting body 121 in a state where the terminal cutting body 121 can relatively move vertically (in directions of relative moves between the first die 112 and the second die 113 during a crimping process) (FIG. 20 and FIG. 21). The holding body 224 is configured to hold the terminal cutting body 121 with the elastic member 123, which is described also in the embodiment, interposed therebetween, and has a plate-shaped part 224*a* between which and the first die 112 the terminal cutting body 121 is inserted and pinched.

The plate-shaped part 224*a* has a vertically extending flat surface. The terminal cutting body 121 slides upward and downward along the flat surface. The terminal cutting body 121 is projected higher than an upper end surface 224$a_1$ of the plate-shaped part 224*a* while being located at an initial position before the start of a crimping process. After the electric wire 50 is held in a desired inclined state by the electric-wire holding space 218A, the terminal cutting body 121 is pressed down by the downward pressing member 122 and the electric-wire presser 218 in line with the progress of the crimping process. Consequently, in line with the progress of the crimping process, the electric wire 50 is gradually released from the inclined state while coming away from the recessed portion 121*e* in the terminal cutting body 121. Upon completion of the crimping process, the electric wire 50 is placed between the upper surface 121*d* of the terminal cutting body 121 and a position located a space away from the upper surface 121*d*, the space corresponding to the plate thickness of the electric-wire connecting portion 12 (FIG. 21).

Here, upon completion of the crimping process, a space is formed between the recessed portion 218*a* in the electric-wire presser 218 and a portion that vertically faces this recessed portion 218*a*, and the electric wire 50 is present in this space. Therefore, when the minimum vertical distance of the space is smaller than the diameter of the electric wire 50, it is likely that excessive force acts on the electric wire 50. For example, the upper surface 121*d* of the terminal cutting body 121 is considered as the portion that faces the recessed portion 218*a*. However, the terminal cutting body 121 is capable of moving vertically relative to the electric-wire presser 218, and therefore moves downward when force is applied thereto. Thus, at the completion of the crimping process, the action of excessive force on the electric wire 50 can be prevented between the recessed portion 218*a* in the electric-wire presser 218 and the upper surface 121*d* of the terminal cutting body 121. At the same time, in this terminal crimping device 100, the upper end surface 224$a_1$ of the plate-shaped part 224*a* of the holding body 224 also vertically faces the recessed portion 218*a* of the electric-wire presser 218 and forms a space 225 therebetween at the completion of a crimping process. The electric wire 50 at the completion of the crimping process is in a state drawn out to the outside of the terminal crimping device 100 through the space 225. In this terminal crimping device 100, the holding body 224 is fixed to the base platform 111A, and the distance between the uppermost and the lowermost positions of the space 225 becomes smaller until the electric-wire presser 218 stops moving downward. Therefore, when the minimum vertical gap of the space 225 is smaller than the diameter of the electric wire 50, it is likely that excessive force acts on the electric wire 50.

Figure 22:
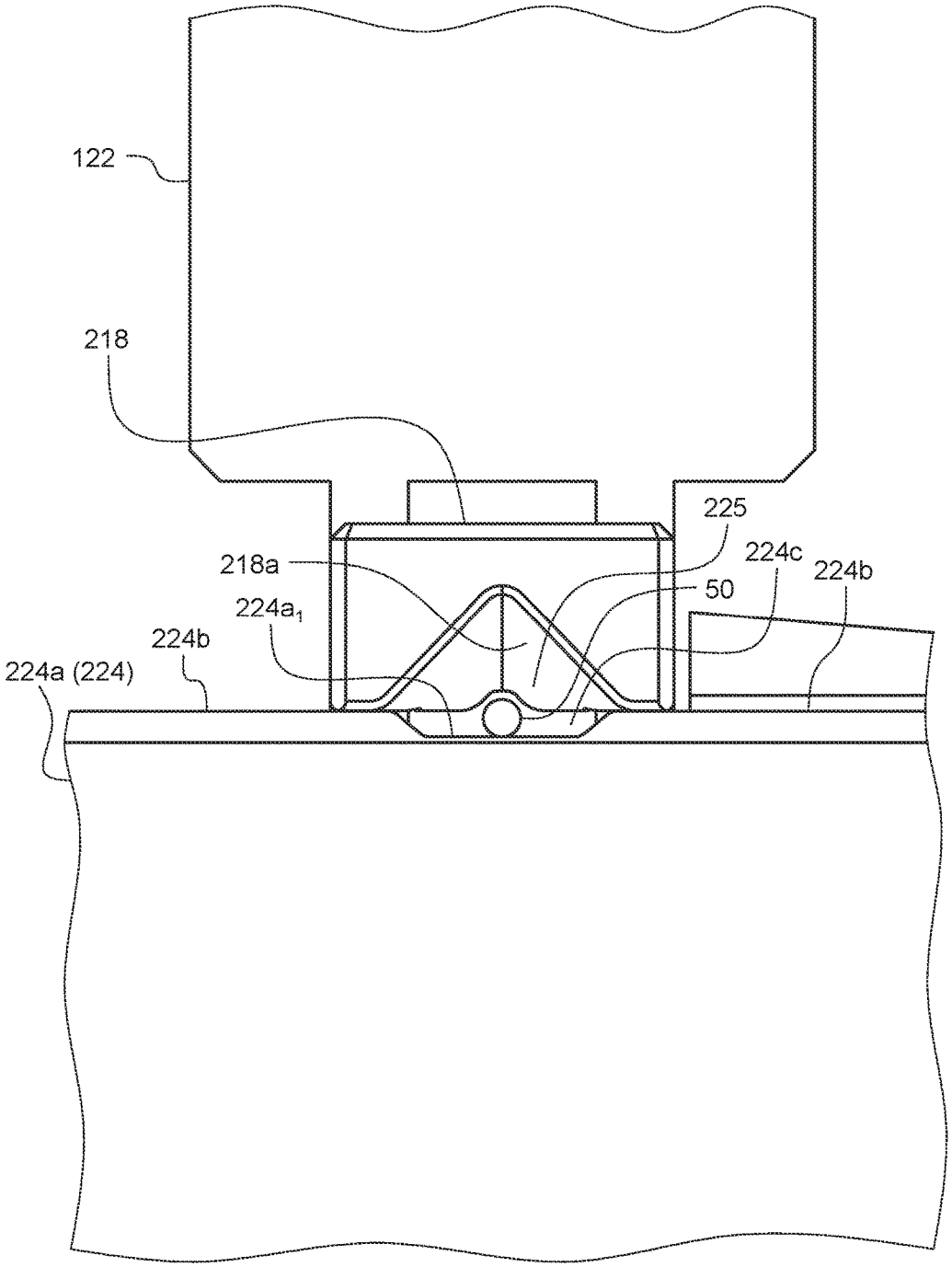
FIG. 22 is a front view illustrating a locking portion of an electric-wire presser according to the modification.

For this reason, this terminal crimping device 100 includes locking portions 224*b* that lock the electric-wire presser 218 that is moving downward, and that makes a minimum vertical distance thereof from the recessed portion 218*a* in the electric-wire presser 218 at the completion of the crimping process larger than a diameter of electric wire 50 (FIG. 20 and FIG. 22).

The locking portions 224*b* in this example are provided on the upper end surface 224$a_1$ of the plate-shaped part 224*a*, and lock, until the completion of the crimping process, the downward moving electric-wire presser 218 so that the minimum vertical gap of the space 225 can be larger than the diameter of the electric wire 50. These locking portions 224*b* are projected upward from the upper end surface 224$a_1$ at two locations so that the electric wire 50 can be placed therebetween at the completion of the crimping process. Consequently, in the plate-shaped part 224*a*, a groove part 224*c* having the upper end surface 224$a_1$ as a groove bottom thereof is formed between these locking portions 224*b*. In this terminal crimping device 100, the presence of these locking portions 224*b* expands the space 225 upward and allows for prevention of the action of excessive force acting on the electric wire 50 in this space 225. Therefore, the electric wire 50 is prevented from being deformed in the space 225, thereby having improved durability. Furthermore, in this terminal crimping device 100, the action of excessive force on the electric wire 50 in the space 225 can be prevented until the completion of a crimping process, which makes it possible to prevent uplift of the electric wire 50 from the bottom portion 14 of the electric-wire connecting portion 12 due to force acting thereon in the space 225. Therefore, this terminal crimping device 100 allows for improvement in crimping process accuracy also in this aspect.

Here, although not being illustrated, the electric-wire presser 218 has an upper part 218*b* thereof (FIG. 18) held by the downward pressing member 122 with the elastic member 130 interposed therebetween, and can move vertically relative to the downward pressing member 122, as in the case of the equivalent thereof described in the embodiment. Thus, in this terminal crimping device 100, even after the electric-wire presser 218 is stopped by the locking portions 224*b* from moving downward, the downward pressing member 122 can be further moved downward, so that a crimping process (including a cutting process of the bridging part 32 and the like) can be completed. The electric-wire presser 218, as in the case of the electric-wire presser 118 in the embodiment, includes overhanging parts 218*c* that is caught and stopped by the wall part 122*b* of the downward pressing member 122 so as to stop the electric-wire presser 218 from moving downward relative to the downward pressing member 122.

The locking portions 224*b* are applicable also to a terminal crimping device in which an electric wire 50 is not to be held in an inclined state, and bring about the same effect even when being applied to such a terminal crimping device.

The terminal crimping device according to the embodiments is thus enabled to reduce a load acting on an electric wire between a portion thereof being held by an inclined electric-wire holding space and a portion thereof being pressed down by a second die. Thus, this terminal crimping device is enabled to prevent uplift of the electric wire from an electric-wire placing portion at the same time as reducing the load acting on the electric wire during a crimping process, thereby preventing a core wire at the tip and a cover from being displaced relative to an electric-wire connecting portion. Therefore, this terminal crimping device allows for a desired crimping process using the electric-wire holding space, thereby allowing for improvement in crimping process accuracy.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal crimping device comprising:

a terminal feeding device that feeds, to a crimping position at which a crimp terminal is crimped to an end portion of an electric wire, the crimp terminal on which a crimping process has not yet been performed;

a crimping device that crimps the crimp terminal having been fed to the crimping position to the end portion of the electric wire by using a first die and a second die; and an electric-wire holding mechanism that holds the electric wire with the end portion of the electric wire placed above an electric-wire connecting portion of the crimp terminal, wherein the electric-wire holding mechanism includes an electric-wire placing portion on which the electric wire is placed with the end portion of the electric wire placed above the electric-wire connecting portion of the crimp terminal, and an electric-wire presser that is moved downward toward the electric-wire placing portion and presses and thereby holds the electric wire placed on the electric-wire placing portion, and between the electric-wire placing portion and a lower surface of the electric-wire presser, an electric-wire holding space is formed that inclines in a same direction to a declining direction in which the end portion of the electric wire is declined in association with downward movement of the second die toward the first die, and that holds the end portion of the electric wire in a thus inclined state placed above the electric-wire connecting portion of the crimp terminal.

2. The terminal crimping device according to claim 1, wherein the electric-wire holding space is formed by a recessed portion formed in the electric-wire placing portion and a recessed portion formed in the lower surface of the electric-wire presser.

3. The terminal crimping device according to claim 2, wherein the recessed portion in the electric-wire placing portion is a V-shaped groove having side walls arranged such that a distance between the side walls of the V-shaped groove of the electric-wire placing portion increases while approaching the lower surface of the electric-wire presser and having a groove bottom inclined so as to be more distant from the lower surface of the electric-wire presser while approaching the end portion of the electric wire, and the recessed portion in the electric-wire presser is a V-shaped groove having side walls arranged such that a distance between the side walls of the V-shaped groove of the electric-wire presser increases while approaching the electric-wire placing portion and having a groove bottom inclined so as to be nearer to the electric-wire placing portion while approaching the end portion of the electric wire.

4. The terminal crimping device according to claim 2, wherein a length of a portion of the electric wire that is held by the electric-wire holding space in the recessed portion in the electric-wire presser, along an axial line of the electric wire, is set to a length that causes the electric wire to be held in the inclined state by the electric-wire holding space when the electric wire is pressed down, sequentially from one side of the electric wire having a core wire exposed at a tip, toward a bottom portion of the electric-wire connecting portion by the second die.

5. The terminal crimping device according to claim 2 further comprising:

a locking portion that locks the electric-wire presser that is moving downward, and that makes a minimum vertical distance to the recessed portion in the electric-wire presser at the completion of the crimping process larger than a diameter of the electric wire.

6. The terminal crimping device according to claim 1, wherein an inclination angle of the electric-wire holding space is set equal to an inclination angle of the end portion of the electrical wire with respect to the electric-wire connecting portion during the crimping process is performed.

7. The terminal crimping device according to claim 1, wherein before the crimping process is actually started or at a same time as the crimping process is actually started, the electric-wire presser is moved downward in a manner that causes the electric wire to be held by the electric-wire holding space.

8. The terminal crimping device according to any one of claims 1 to 7, wherein in a case where, while a plurality of crimp terminals are coupled with a connecting piece with a bridging part bridging each of the crimp terminals and the connecting piece, the electric-wire placing portion is provided in a terminal cutting machine that cuts the bridging part of one of the crimp terminals by inserting and pinching the bridging part between two terminal cutting parts, the one of the crimp terminals having been fed to the crimping position, the terminal cutting machine includes a terminal cutting body that has one of the two terminal cutting parts and moves down in order to move the one of the two terminal cutting parts toward the other one of the two terminal cutting parts, the terminal cutting body including a slit into which the connecting piece is inserted with a part of the bridging part coupled with one of the crimp terminals being projected, the one of the crimp terminals having been fed to the crimping position, and an upper edge portion as the one of the two terminal cutting parts that is located at an opening of the slit that faces the crimp terminal, and the terminal cutting machine utilizes an upper surface of the terminal cutting body as the electric-wire placing portion.

9. The terminal crimping device according to claim 3, wherein a length of a portion of the electric wire that is held by the electric-wire holding space in the recessed portion in the electric-wire presser, along an axial line of the electric wire, is set to a length that causes the electric wire to be held in the inclined state by the electric-wire holding space when the electric wire is pressed down, sequentially from one side of the electric wire having a core wire exposed at a tip, toward a bottom portion of the electric-wire connecting portion by the second die.

10. The terminal crimping device according to claim 3 further comprising:

a locking portion that locks the electric-wire presser that is moving downward, and that makes a minimum vertical distance to the recessed portion in the electric-wire presser at the completion of the crimping process larger than a diameter of the electric wire.

11. The terminal crimping device according to claim 4 further comprising:

a locking portion that locks the electric-wire presser that is moving downward, and that makes a minimum vertical distance to the recessed portion in the electric-wire presser at the completion of the crimping process larger than a diameter of the electric wire.

12. The terminal crimping device according to claim 2, wherein an inclination angle of the electric-wire holding space is set equal to an inclination angle of the end portion of the electrical wire with respect to the electric-wire connecting portion during the crimping process is performed.

13. The terminal crimping device according to claim 3, wherein an inclination angle of the electric-wire holding space is set equal to an inclination angle of the end portion of the electrical wire with respect to the electric-wire connecting portion during the crimping process is performed.

14. The terminal crimping device according to claim 4, wherein an inclination angle of the electric-wire holding space is set equal to an inclination angle of the end portion of the electrical wire with respect to the electric-wire connecting portion during the crimping process is performed.

15. The terminal crimping device according to claim 5, wherein an inclination angle of the electric-wire holding space is set equal to an inclination angle of the end portion of the electrical wire with respect to the electric-wire connecting portion during the crimping process is performed.

16. The terminal crimping device according to claim 2, wherein before the crimping process is actually started or at a same time as the crimping process is actually started, the electric-wire presser is moved downward in a manner that causes the electric wire to be held by the electric-wire holding space.

17. The terminal crimping device according to claim 3, wherein before the crimping process is actually started or at a same time as the crimping process is actually started, the electric-wire presser is moved downward in a manner that causes the electric wire to be held by the electric-wire holding space.

18. The terminal crimping device according to claim 4, wherein before the crimping process is actually started or at a same time as the crimping process is actually started, the electric-wire presser is moved downward in a manner that causes the electric wire to be held by the electric-wire holding space.

19. The terminal crimping device according to claim 5, wherein before the crimping process is actually started or at a same time as the crimping process is actually started, the electric-wire presser is moved downward in a manner that causes the electric wire to be held by the electric-wire holding space.

20. The terminal crimping device according to claim 6, wherein before the crimping process is actually started or at a same time as the crimping process is actually started, the electric-wire presser is moved downward in a manner that causes the electric wire to be held by the electric-wire holding space.

* * * * *